US012644214B2

(12) United States Patent
Fushimi

(10) Patent No.: US 12,644,214 B2
(45) Date of Patent: Jun. 2, 2026

(54) METHOD FOR PRODUCING SMART TEXTILES

(71) Applicant: Tajima Industries Ltd., Aichi (JP)

(72) Inventor: Akihiko Fushimi, Aichi (JP)

(73) Assignee: Tajima Industries Ltd., Kasugai (JP)

( * ) Notice: Subject to any disclaimer, the term of this patent is extended or adjusted under 35 U.S.C. 154(b) by 0 days.

(21) Appl. No.: 18/996,204

(22) PCT Filed: Jul. 5, 2023

(86) PCT No.: PCT/JP2023/024907
§ 371 (c)(1),
(2) Date: Jan. 17, 2025

(87) PCT Pub. No.: WO2024/018897
PCT Pub. Date: Jan. 25, 2024

(65) Prior Publication Data

US 2026/0035846 A1 Feb. 5, 2026

(30) Foreign Application Priority Data

Jul. 20, 2022 (JP) ..... 2022-115400

(51) Int. Cl.
*D05C 7/00* (2006.01)
*D05B 65/02* (2006.01)
*D05B 93/00* (2006.01)

(52) U.S. Cl.
CPC ..... *D05C 7/00* (2013.01); *D05B 65/02* (2013.01); *D05B 93/00* (2013.01); *D05D 2303/40* (2013.01); *D10B 2401/16* (2013.01)

(58) Field of Classification Search
CPC . D05C 7/00; D05C 7/08; D05B 93/02; D05B 93/00; D05B 65/02
See application file for complete search history.

(56) References Cited

U.S. PATENT DOCUMENTS

| | | | | |
|---|---|---|---|---|
| 11,262,873 | B2 * | 3/2022 | Tremmel | G06F 3/0446 |
| 2010/0199903 | A1 * | 8/2010 | Deaett | H01Q 1/273 112/475.19 |
| 2020/0125195 | A1 * | 4/2020 | Tremmel | G06F 3/041 |

FOREIGN PATENT DOCUMENTS

| | | | | |
|---|---|---|---|---|
| DE | 112023003143 | T5 * | 6/2025 | D05B 93/00 |
| JP | S59203391 | A * | 11/1984 | |
| JP | S61126793 | A * | 6/1986 | |
| JP | H05121149 | A * | 5/1993 | |
| JP | H05326115 | A * | 12/1993 | |
| JP | 2002-164156 | A | 6/2002 | |
| JP | 2005-279069 | A | 10/2005 | |
| JP | 2018-009259 | A | 1/2018 | |
| JP | 2021-094280 | A | 6/2021 | |

* cited by examiner

*Primary Examiner* — Danny Worrell
(74) *Attorney, Agent, or Firm* — Christensen, Fonder, Dardi & Busse PLLC; John P. Fonder

(57) ABSTRACT

A method for producing a smart textile includes stitching with a conductive thread from a first point outside a segmented area that is set on a sheet material toward a second point on the segmented area. An embroidery with the conductive thread is sewn from the second point as a starting point to apply a segment in the segmented area. These series of steps are executed without performing a process for cutting the conductive thread by stopping the sewing process of the conductive thread.

8 Claims, 13 Drawing Sheets

METHOD FOR PRODUCING SMART TEXTILES

CROSS-REFERENCE TO RELATED APPLICATIONS

The present application is a 35 U.S.C. § 371 U.S. National Phase entry of, and claims priority to, PCT Application PCT/JP2023/024907 filed Jul. 5, 2023, which claims priority to Japanese Patent Application No. 2022-115400 filed Jul. 20, 2022, which is hereby incorporated herein by reference in its entirety for all purposes.

BACKGROUND

The present disclosure relates to a method for producing smart textiles using a sewing machine. A smart textile has a base material made of insulating sheet material and conductive threads sewn onto the base material.

In this disclosure, "smart textile" refers to a textile with a section formed of conductive threads on a part of an insulating sheet material. This constitutes a fabric structure (textile) that exhibits functions as an electronic component or electronic circuit, or an assembly including the textile structure. In this smart textile, stitching with conductive thread is applied onto a base material made of insulating sheet material. For example, in JP2021-094280A, an embroidery with conductive threads is performed by a sewing machine.

When any type of sewing, including embroidery, is performed by a sewing machine, the sewing thread may form a tangled clump at a beginning of a sewing process. This clump may be referred to as various names, such as "bird nesting," "thread bunching," or "tangled thread," for example, in this disclosure, however it shall be referred to by the name "bird nesting." This bird nesting may be formed, for example, when an end of a sewing thread that does not form a sewing stitch is tangled in the sewing stitch at the beginning of the sewing process.

This bird nesting is formed of conductive thread. Therefore, contact with other elements and/or conductors may cause a short circuit and/or a leakage of electricity in smart textiles. For this reason, conventional production of smart textile by a sewing machine needs more works to remove the bird nesting.

More specifically, a bird nesting is formed when a conductive thread becomes tangled in sewing stitches. The tangled conductive thread is separated from the sewing stitches. In this process, the conductive thread tangled in the sewing stitches is often cut. The conductive thread is then pulled out of the sewing stitches. In addition, the conductive thread must be carefully worked to avoid fraying, deformation, and damages in the sewing stitches so as not to adversely affect the function as an electronic component or an electronic circuit. This leads to poor production efficiency and/or yield of smart textiles.

Thus, there is a need for technology that requires no additional work to make the smart textile using the sewing machine.

SUMMARY

According to one aspect of the present disclosure, it provides a production method for producing smart textiles in which stitching with conductive thread is applied onto a base material made of an insulating sheet material using a sewing machine. This production method includes a first stitching step and an embroidery step. In the first stitching step, a segmented area is set on a sheet material in which a segment, stitching representing a function as an element, is applied. The stitching with conductive thread is performed from a first point outside the segmented area toward a second point on the segmented area. In the embroidery step, the embroidery with conductive thread is sewn with the second point as a starting point. A series of steps from the first stitching step through the embroidery step is executed without performing a process for cutting the conductive thread by stopping the sewing process of the conductive thread.

According to the above production method, the first point, which is a sewing starting point of the sewing machine, where the bird nesting may be formed, is positioned at a location spaced apart from the segmented area. Therefore, even if a bird nesting is formed at the first point, the risk of this bird nesting coming into contact with the segment is reduced. This reduces the need for additional work when producing smart textiles by a sewing machine. The additional work may be a work to check for the presence or absence of bird nesting in the smart textile. Alternatively, it may be a work to remove the bird nesting, if there is any.

The production method determines the first point as the beginning of the sewing process by a sewing machine. The first point may be set at a location farther apart from the segmented area than the size of the bird nesting that may occur at the first point.

According to the above production method, even if a bird nesting is formed at the first point, which is the beginning of the sewing process by the sewing machine, it is avoided that this bird nesting comes into contact with the segment. This reduces the need for additional work when producing smart textiles by a sewing machine.

The above production method may further include a cutting step, which will be described later. In this cutting step, the conductive thread extending from the segment toward the outside the segmented area is cut. This allows the conductive threads constituting the segment to be insulated and separated from the conductive thread outside the segmented area.

The beginning of the sewing process by the sewing machine is a location where the bird nesting may be formed. According to the above production method, the beginning of the sewing process is insulated from the conductive thread of the segment, regardless of whether or not the bird nesting has actually formed at the beginning of the sewing process. This reduces the need for additional work when producing smart textiles by a sewing machine.

The above production method may include a second stitching step and a thread cutting step, which will be described below. In the second stitching step, stitching with conductive thread proceeds from a third point, which is a point on the segmented area where the embroidery process stops, toward a fourth point outside the segmented area. In the thread cutting step, the stitching with conductive thread is stopped at the fourth point to cut the conductive thread. The method includes a series of steps from the first stitching step through the embroidery step to the second stitching step. This series of steps is executed without performing a process for cutting the conductive thread by stopping the stitching process with the conductive thread.

When sewing of any kind, including embroidery, is performed with a sewing machine, thread extensions may occur at the end of the stitching. These extensions are referred to by various names, such as "HIGE (thread tail)", "remaining thread," or "thread chain", but in this disclosure, they will be referred to as a "thread tail." When smart textiles are produced by a sewing machine, the thread tail is formed of conductive thread. Therefore, when this thread tail comes into contact with other elements and/or conductors, it may cause a short circuit and/or a leakage of electricity in the smart textile. However, according to the above production method, the sewing end point of the sewing machine where the thread tail is formed is set at a location distanced from the segmented area. Therefore, the risk of thread tail extending from this end-of-sewing area coming into contact with the segment is reduced. This may reduce the occurrence of the risk of a short circuit and/or a leakage of electricity in smart textiles.

In the above production method, the fourth point may be set at a location spaced apart from the segmented area by a predetermined distance. The predetermined distance is longer than the length of the thread tail of the conductive thread extending from the fourth point by the thread cutting step.

According to the above production method, it is avoided that the thread tail extending from the fourth point, which serves as a sewing end point of the sewing machine, is prevented from coming into contact with the segment. This may further reduce the occurrence of the risk of a short circuit and/or a leakage of electricity in smart textiles.

The above production method may include setting of an area to be processed on the sheet material, which is the area to be processed on the base material that encompasses the segmented area, and a boundary of this area to be processed. In this case, the first point is set outside the area to be processed that has been set. In the first stitching step, the stitching with the conductive thread proceeds from the first point across the above boundary toward the second point. Furthermore, a separating and cutting step of the area to be processed is performed together by cutting with at least a part of the above boundary as a cutting line.

According to the above production method, the insulation separation of sewing and the separation of the area to be processed are collectively done together. This improves production efficiency when producing smart textiles.

The above production method may include a second stitching step and a thread cutting step that will be described later. In the second stitching step, the stitching with the conductive thread proceeds from the third point, which is the point on the segmented area where the embroidery process ends, toward the fourth point outside the segmented area. In the thread cutting step, the stitching with the conductive thread is stopped at the fourth point and the conductive thread is cut. A series of steps is performed from the first stitching step through the embroidery step to the second stitching step. A series of steps is executed without performing a process of cutting the conductive thread by stopping the stitching with the conductive thread. An area to be processed, which is an area including a segmented area and to be processed on the base material, and a boundary with this area to be processed are set on the sheet material. In the second stitching step, the stitching with the conductive thread proceeds from the third point across the boundary toward the fourth point. A separating and cutting step of the area to be processed is performed together by cutting with at least a part of the above boundary as a cutting line.

According to the above production method, the risk of thread tail extending from the sewing end point of the sewing machine coming into contact with the segment is reduced. This may reduce the occurrence of the risk of a short circuit and/or a leakage of electricity in a smart textile. Further, the insulation separation of stitches and the separation of the area to be processed are collectively done together. This improves production efficiency when producing smart textiles.

The production method provides a connecting thread without thread looping, which occurs when the conductive threads are twisted together on the textile during stitching with the conductive thread at a location running across the cutting point of the conductive thread in the cutting step. Accordingly, it is possible to prevent thread looping during the sewing process to facilitate cutting the conductive threads.

DETAILED DESCRIPTION

First Embodiment

A smart textile 110 produced by a production method of a first embodiment will be described primarily with reference to FIG. 1. This smart textile 110 has a sheet material 120 made of insulating nonwoven fabric as a base material 110A. Stitches 111 and 112 are applied to each of two segmented areas 111A and 112A set on this base material 110A. The smart textile 110 may be used as a substrate, for example, an electronic component (not shown) for attaching other electronic components.

The stitches 111 and 112 are formed on the base material 110A, respectively, by a lockstitch embroidery machine (not shown), a type of sewing machine. This forms pads that are insulated and separated from others. These pads are surface embroidery. Other electronic components are electrically connected to the pads by bonding or sewing. In other words, the pads serve as electrical elements (base, contacts, joints). The stitches 111 and 112 correspond to "segments" in the present disclosure.

In this embodiment, each of the segmented areas 111A and 112A has a planar shape of the same size. As shown in FIG. 1, the segmented areas 111A and 112A are rectangular, but may be other shapes, for example, a circular shape. Each stitch 111 and 112 is applied to fill the entire corresponding segmented area.

Figure 1:
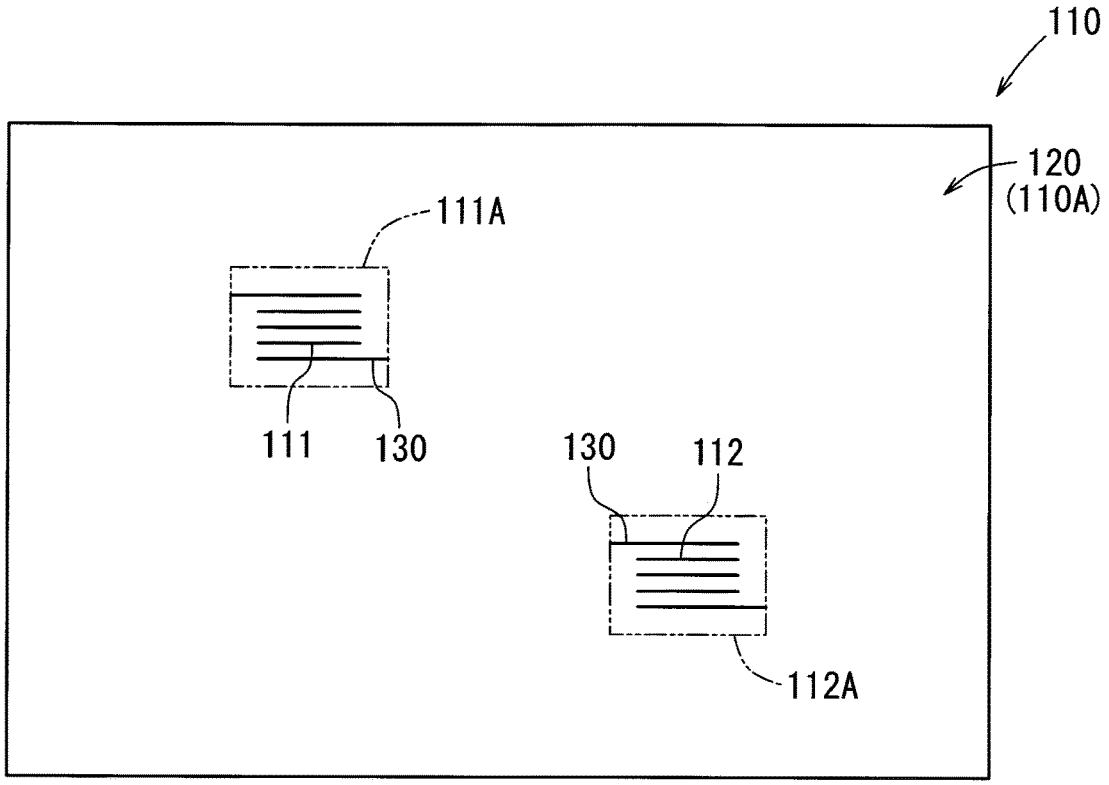
FIG. 1 is a surface view representing a smart textile produced by a method for producing smart textiles according to a first embodiment of the present disclosure.

In FIG. 1, each stitch 111 and 112 is illustrated as embroidery sewn by a "satin" stitch pattern of the lockstitch. However, each stitch 111 and 112 may be formed by any stitch patterns capable of forming a surface embroidery, such as, for example, a "tatami" stitch pattern or a "cross" stitch pattern.

Subsequently, an example of the method for producing the aforementioned smart textile 110 will be described, primarily with reference to FIG. 2 through FIG. 7.

To produce the smart textile 110, a sewing machine with an embroidery function is first prepared. In this embodiment, a lockstitch embroidery machine (not shown) is prepared as the sewing machine, which is capable of switching various stitch patterns, including "running," "satin," "tatami," and "cross" stitch patterns to proceed with the sewing.

This lockstitch embroidery machine is a device capable of automatically executing both a following jump stitch process and a stitch length adjustment process. In the jump stitch process, a relative position of the sewing needle to the fabric is shifted while the sewing needle used to proceed with sewing with a sewing thread (see a conductive thread 130 in FIG. 2) is kept pulled out from a fabric (see a sheet material 120 in FIG. 2). In the stitch length adjustment process, length of a stitch (see stitch 131A in FIG. 2) set between a thread loop (see thread looping 131 in FIG. 2), where the sewing thread entwines, is partially adjusted.

The lockstitch embroidery machine is equipped with an automatic thread trimming function that automatically cuts the sewing thread connected to the fabric after sewing with the sewing thread is completed. When the sewing thread is cut by the automatic thread trimming function, a certain length of sewing thread is known to remain on the back of the fabric in a form of a thread tail (see FIG. 6, thread tail 130B).

Figure 2:
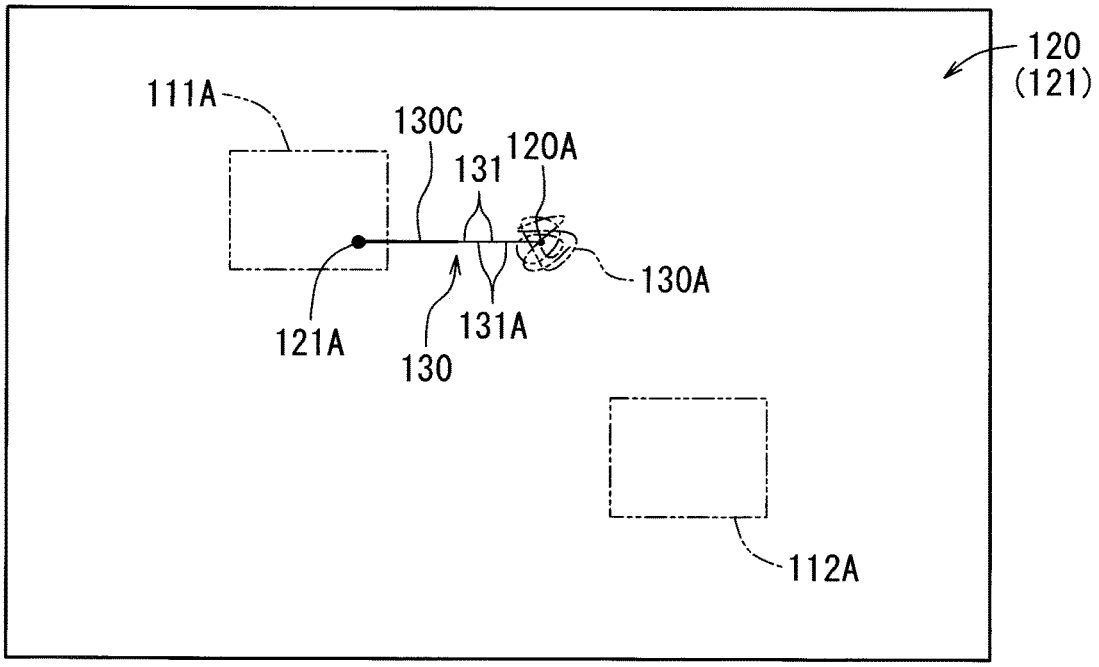
FIG. 2 is an explanatory diagram for explaining the method for producing the smart textile of FIG. 1.

Subsequently, as shown in FIG. 2, a sheet material 120 made of insulating non-woven fabric is prepared. This entire sheet material 120 is designated as an area to be processed 121, which is an area to be processed into a base material 110A (see FIG. 1). Furthermore, two segmented areas 111A and 112A are set in this area to be processed 121. Here, in FIG. 2, boundaries of each segmented area 111A and 112A are illustrated as imaginary ones without physical forms. However, these boundaries may be physical markings made by a tool such as a "roulette" or "chalk," for example.

Subsequently, using the sewing machine described above, a first point 120A, which is outside the segmented area 111A, is determined as a sewing starting point. Then, the sewing with the conductive thread 130 is advanced in a linear fashion toward a second point 121A, which is on the segmented area 111A. In this embodiment, the linear sewing with the conductive thread 130 proceeds to form a straight line by "running" stitch pattern. This step corresponds to a "first stitching step" in the present disclosure. The linear sewing with the conductive thread 130 may proceed to form a curve.

In the first stitching step, the first point 120A is set as the sewing starting point. Specifically, the first point 120A is set at a location separated from the segmented area 111A by a distance longer than an anticipated size of the bird nesting 130A. That is, the first point 120A is set at a separated location where the bird nesting 130A does not contact the stitch 111 within the segmented area 111A. When proceeding with the stitching with the conductive thread 130, either the jump stitch process or the stitch length adjustment process is performed. Then, a connecting thread 130C is provided where a thread loop 131 is not formed at a location running across the boundary of the segmented area 111A. In this embodiment, the length of the connecting thread 130C is set so that a number of thread loops 131 formed in the first stitching step corresponds to several stitches.

Figure 3:
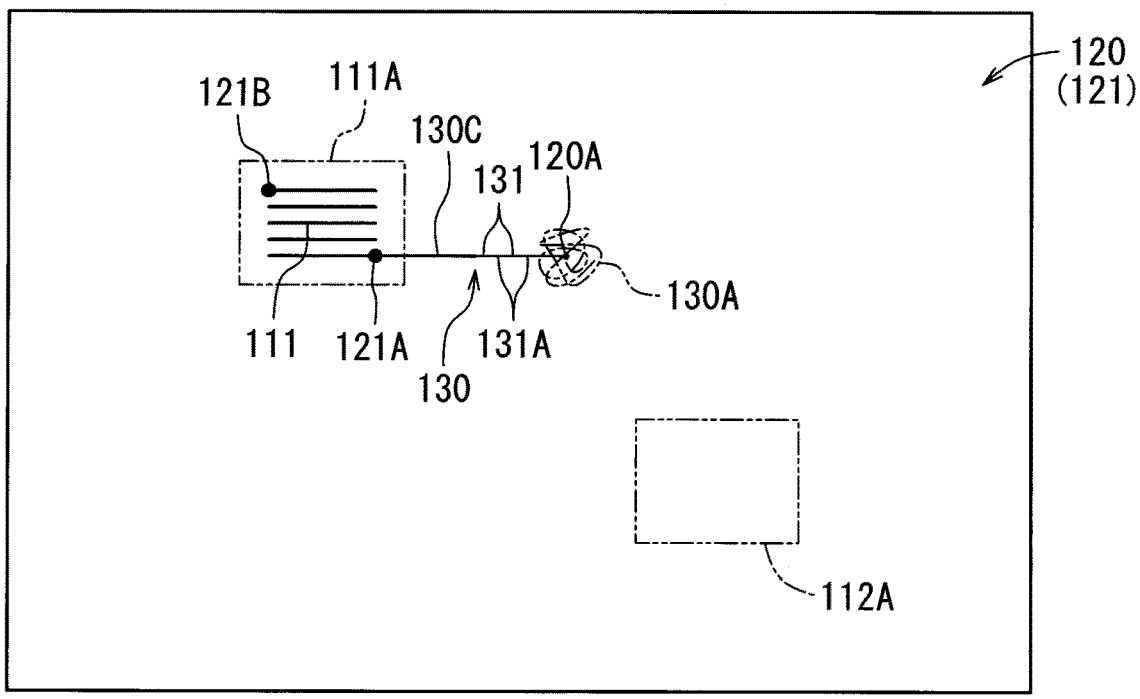
FIG. 3 is an explanatory diagram for explaining the method for producing the smart textile of FIG. 1.

Subsequently, the stitching pattern of the sewing machine is changed to a stitching pattern capable of forming a surface embroidery. For example, the stitching pattern is changed to a "satin", "tatami" or "cross" stitch pattern. As shown in FIG. 3, a surface embroidery with a conductive thread 130 is sewn with the second point 121A as a starting point. This will apply the stitch 111 in the segmented area 111A. This corresponds to an "embroidery step" in the present disclosure.

Figure 4:
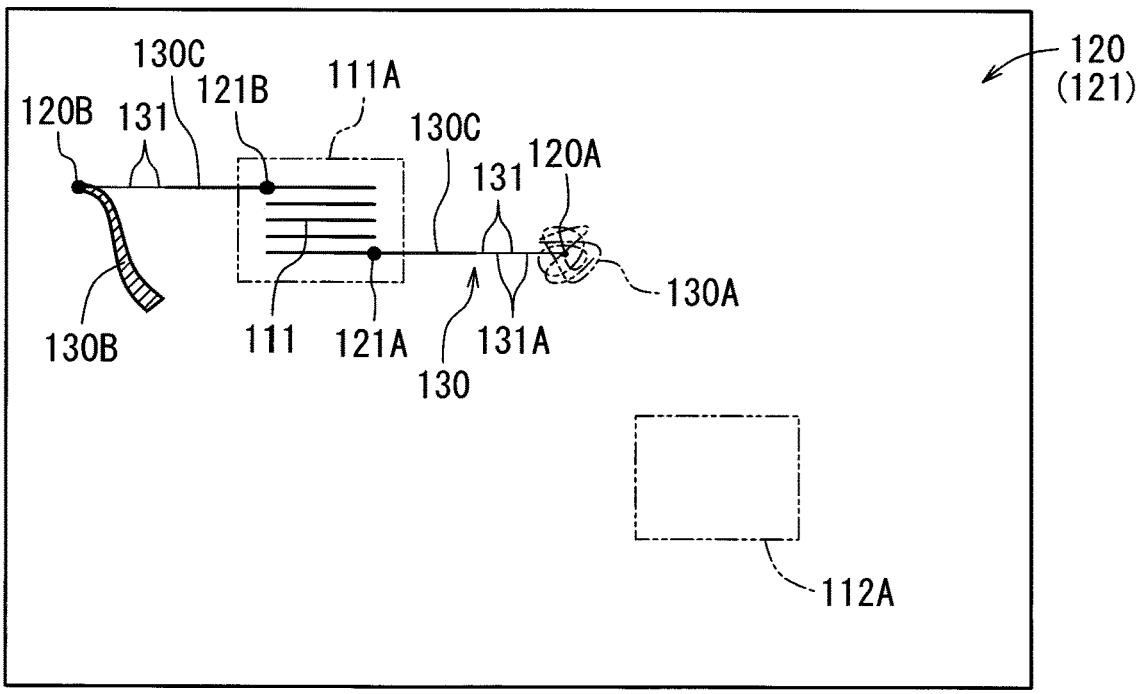
FIG. 4 is an explanatory diagram for explaining the method for producing the smart textile of FIG. 1.

Subsequently, as shown in FIG. 4, a linear sewing with the conductive thread 130 proceeds from a third point 121B. The third point 121B is located in the segmented area 111A within the area to be processed 121. This sewing proceeds toward a fourth point 120B. The fourth point 120B is located outside the segmented area 111A and serves as an end point of the embroidery process of the stitch 111. In the present embodiment, the linear sewing with the conductive thread 130 proceeds to form a straight line by a "running" stitch pattern. This step corresponds to a "second stitching step" in the present disclosure. The linear stitching with the conductive thread 130 may proceed to form a curve.

In the second stitching step, the fourth point 120B, which serves as the sewing end point, is set at a location spaced apart from each segmented area 111A and 112A by a predetermined distance. The predetermined distance is longer than the length of the thread tail 130B (see FIG. 6) that is formed by the automatic thread trimming function of the sewing machine. Therefore, it is avoided that the thread tail 130B comes into contact with the stitches 111 in the segmented area 111A. When proceeding with the stitching with the conductive thread 130, either the above jump stitch process or the stitch length adjustment process is performed. Then, a connecting thread 130C is provided where a thread loop 131 is not formed at a location running across the boundary of the segmented area 111A. In this embodiment, the length of the connecting thread 130C is set so that a number of thread loops 131 formed in the second stitching step corresponds to several stitches.

This production method includes a series of steps from the first stitching step through the embroidery step to the second stitching step. This series of steps is executed without performing a process for cutting the conductive thread 130 by stopping the sewing process of the conductive thread 130.

When the sewing with the conductive thread 130 has advanced to the fourth point 120B, the sewing with the conductive thread 130 is stopped. Then, a thread cutting step is performed to cut the conductive thread 130. At this time, the conductive thread 130 is cut by the automatic thread trimming function of the sewing machine. As a result, a thread tail 130B of a predetermined length is formed at the fourth point 120B. This thread tail 130B extends out from the fourth point 120B.

Figure 5:
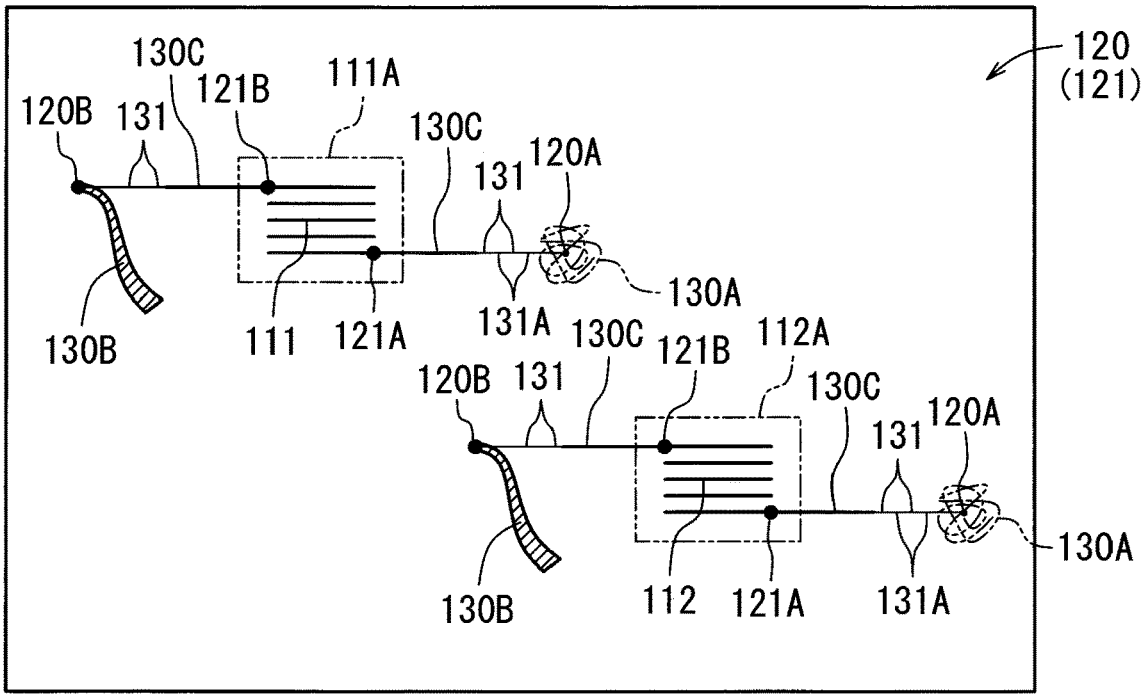
FIG. 5 is an explanatory diagram for explaining the method for producing the smart textile of FIG. 1.

Subsequently, as shown in FIG. 5, a series of steps similar to those described above from the first stitching step through the embroidery step to the second stitching step is also performed in a segmented area 112A. As a result, stitches 112 are applied in the segmented area 112A. The segmented area 112A also has each of the components corresponding to those of the segmented area 111A.

Figure 6:
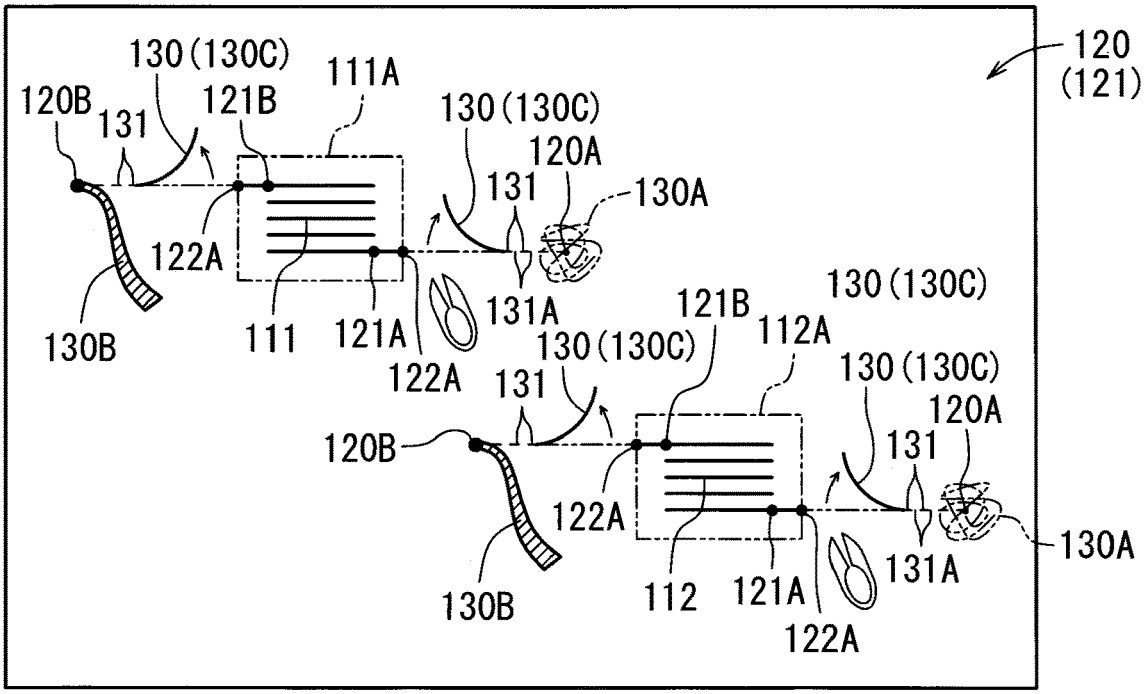
FIG. 6 is an explanatory diagram for explaining the method for producing the smart textile of FIG. 1.

Subsequently, as shown in FIG. 6, the conductive threads 130 extending from each of the stitches 111 and 112 toward the outside each segmented area 111A and 112A are then cut. This allows the conductive threads 130 forming each of the stitches 111 and 112 to be insulated and separated from the conductive threads 130 outside each segmented area 111A and 112A. This step corresponds to a "cutting step" in the present disclosure.

In the cutting step, the connecting thread 130C extending from each of the stitches 111 and 112 is cut at a cutting point 122A set on the boundary of each segmented area 111A and 112A as shown in FIG. 6. This cutting is done carefully so as not to damage each of the stitches 111 and 112 and the sheet material 120.

In FIG. 6, the cutting of the conductive thread 130 is illustrated as a manual operation performed with a "pair of grip scissors". However, the conductive thread 130 may be cut by various tools, such as, for example, "shears" or "knives." The cutting of the conductive thread 130 may also be performed automatically by a machine.

Figure 7:
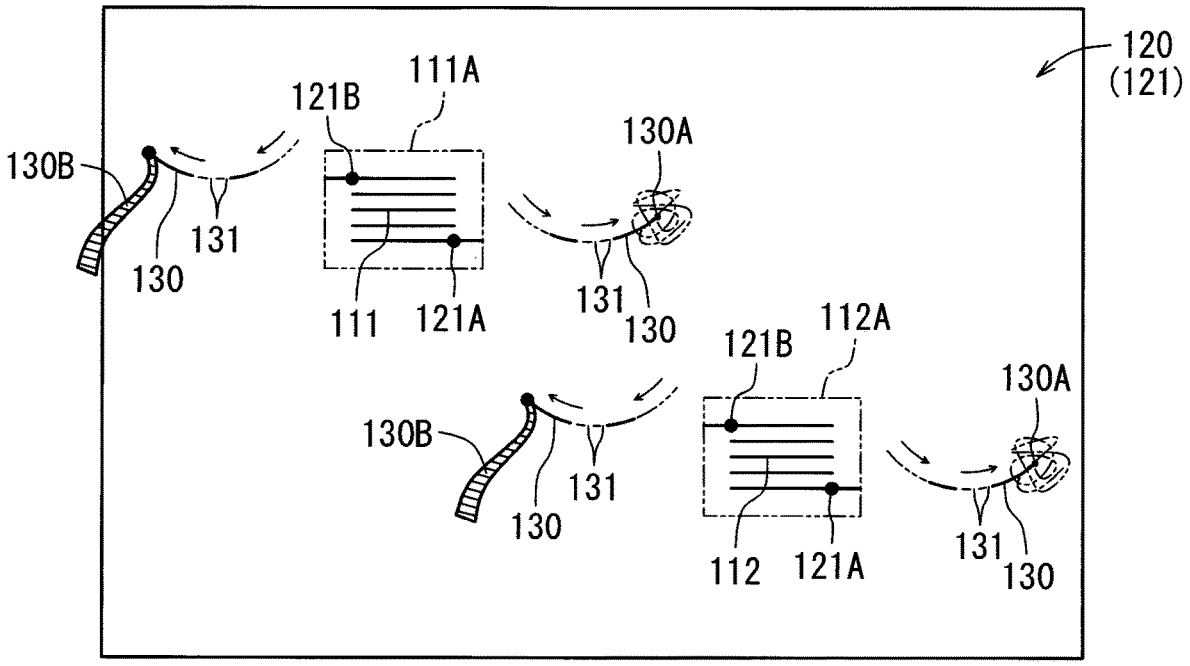
FIG. 7 is an explanatory diagram for explaining the method for producing the smart textile of FIG. 1.

Then, as shown in FIG. 7, the conductive thread 130, which has been insulated and separated from each of the stitches 111 and 112 in the cutting step, is pulled out from the sheet material 120. At this time, the conductive thread 130 to be pulled out is sewn onto the sheet material 120 with only a few thread loops 131. Therefore, the conductive thread 130 is easily pulled out and removed from the sheet material 120. In the present embodiment, the conductive thread 130 is pulled out from an opposite side of these stitches 111 and 112 to reduce risk of damaging each stitch 111 and 112. In FIG. 7, the conductive thread 130 is pulled out to a side where the bird nesting 130A or thread tail 130B is located.

Once the pulling out of the conductive thread 130 is completed, the sheet material 120 will be in a state shown in FIG. 1, and the smart textile 110 will be finished.

The smart textile 110 is produced as described above. According to this method, the beginning of the sewing process by the sewing machine, where the bird nesting 130A may form, is positioned at a location spaced apart from each segmented area 111A and 112A. Therefore, even if a bird nesting 130A were to form in this area, risk of this bird nesting 130A coming into contact with each of the stitches 111 and 112 may be reduced. This reduces a need for additional work when producing the smart textile 110 by sewing machine. The additional work may involve a work, for example, to check for the presence or absence of the bird nesting 130A in the smart textile 110. Alternatively, it may be a work of removing the bird nesting 130A, if there is any.

There may be cases where a bird nesting 130A is formed at the first point 120A, which serves as a sewing starting point of the sewing machine. However, even in this case, according to the above-described method for producing the smart textile 110, this bird nesting 130A is avoided from coming into contact with each of the stitches 111 and 112. This may reduce the need for additional work.

The beginning of the sewing process by the sewing machine is also a location where the bird nesting 130A may form. According to the above-described method, the beginning of the sewing process by the sewing machine is insulated and separated from each of the stitches 111 and 112 of the conductive thread 130 regardless of whether or not a bird nesting 130A has actually formed in this beginning of the sewing process by the sewing machine. This may reduce the need for additional work.

According to the above-described method, the bird nesting 130A is not likely to be formed within the segmented areas 111A and 121A (stitches 111 and 112). Therefore, fraying, deformation or damage to the conductive threads 130, which are likely to occur as a result of the bird nesting 130A removal process, may be avoided. Thus, adverse effects on the function of the smart textile 110 as an electronic component or electronic circuit may be suppressed. This may improve the reliability of the product quality of the smart textile 110 produced accordingly.

According to the above-described method, the sewing end point of the sewing machine, where the thread tail 130B may be formed, is positioned at a location spaced apart from each segmented area 111A and 112A. This reduces the risk of the thread tail 130B extending out from the sewing end point of the sewing machine coming into contact with each of the stitches 111 and 112. This may reduce the risk of a short circuit and/or a leakage of electricity in the smart textile 110 produced by the sewing machine.

According to the above-described method, a thread tail 130B may be extended out from the fourth point 120B, which is the sewing end point of the sewing machine. It is avoided that this thread tail 130B comes into contact with each segmented area 111A and 112A. This may further reduce the risk of a short circuit and/or a leakage of electricity in the smart textile 110.

Further, according to the above-described method, the sewing end point is insulated and separated from each of the stitches 111 and 112 of the conductive thread 130. This may further reduce the possibility of a short circuit and/or a leakage of electricity in the smart textile 110.

Furthermore, thread loop 131 where the conductive threads 130 entwine in the sewing process by the sewing machine may be generated. However, according to the above-described method, the thread loop 131 may be prevented from being located at a location running across the cutting point 120A of the conductive thread 130. As a result, it is possible to reduce the risk that the cutting of the conductive thread 130 becomes difficult in the cutting step due to the thread loop 131.

Second Embodiment

Hereinafter, a smart textile 210 produced by a production method of a second embodiment will be described primarily with reference to FIG. 8. This smart textile 210 has a sheet material 220 (see FIG. 9) made of insulating nonwoven fabric as a base material 210A. Stitches 111 and 112 are formed to each of two segmented areas 111A and 112A set on this base material 110A. One segmented area 211A is set in this base material 210A. Stitches 211 are applied in the segmented area 211A.

The stitches 211 are formed on the base material 210A by a lockstitch embroidery machine (not shown), a type of sewing machine. This forms a pad that is insulated and separated from others. This pad may be a surface embroidery. The stitches 211 correspond to a "segment" in the present disclosure.

In this embodiment, the conductive thread 230 forming the stitches 211 extends out of the segmented area 211A at its end. The conductive thread 230 is sewn to the base material 210A by a "running" stitch pattern of the lockstitch.

Figure 8:
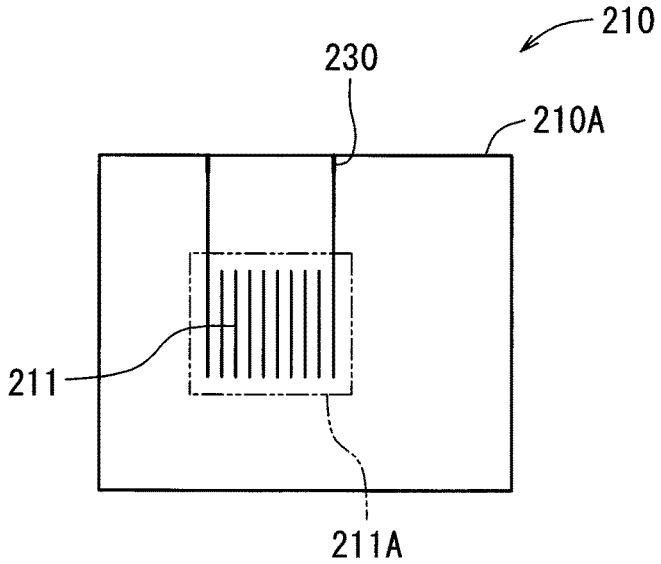
FIG. 8 is a surface view representing a smart textile produced by a method for producing smart textiles according to a second embodiment of the present disclosure.

In FIG. 8, the stitches 211 are illustrated as embroidery sewn by the "satin" stitch pattern of the lockstitch. However, the stitches 211 may be formed by any stitch patterns capable of forming a surface embroidery, such as, for example, a "tatami" stitch pattern or a "cross" stitch pattern.

Hereinafter, an example of the method for producing the aforementioned smart textile 210 will be described, primarily with reference to FIG. 9 through FIG. 12. To produce the smart textile 210, a sewing machine with an embroidery function is first prepared.

Figure 9:
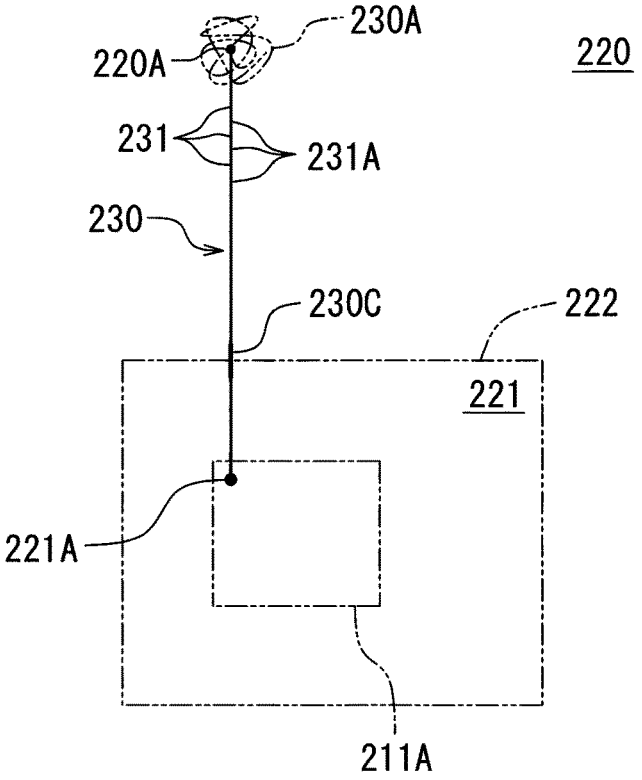
FIG. 9 is an explanatory diagram for explaining the method for producing the smart textile of FIG. 8.

As shown in FIG. 9, a sheet material 220 made of insulating non-woven fabric is prepared. Then, on this sheet material 220, an area to be processed 221 on the base material 210A (FIG. 8), a boundary 222 of this area to be processed 221, and a segmented area 211A are set. The segmented area 211A is set so that an entire segmented area 211A is encompassed in the area to be processed 221. In FIG. 9, the boundary 222 of the area to be processed 221 and the boundary of the segmented area 211A are illustrated as imaginary ones without physical forms. However, these boundaries may be physical markings made by a tool such as a "roulette" or "chalk," for example.

Subsequently, using the sewing machine described above, the first point 220A, which is outside the area to be processed 211A (outside the segmented area 211A as well), is determined as the sewing starting point. Then, the sewing with the conductive thread 230 is advanced in a linear fashion from the first point 220A across the boundary 222 toward the second point 221A, which is on the segmented area 211A in the are to be processed 221. In this embodiment, the linear sewing with the conductive thread 230 proceeds to form a straight line by "running" stitch pattern. This step corresponds to the "first stitching step" in the present disclosure.

In the first stitching step, the first point 220A is set as a sewing starting point. Specifically, the first point 220A is set at a location separated from the boundary 222 and the segmented area 211A by a distance longer than the anticipated size of the bird nesting 230A. That is, the first point 220A is set at a separated location where the bird nesting 230A does not contact the stitch 211 within the segmented area 211A. When proceeding with the stitching with the conductive thread 230, either the jump stitch process or the stitch length adjustment process is performed. Then, a connecting thread 230C is provided where thread loops 231 are not formed at a location running across the boundary 222.

Figure 10:
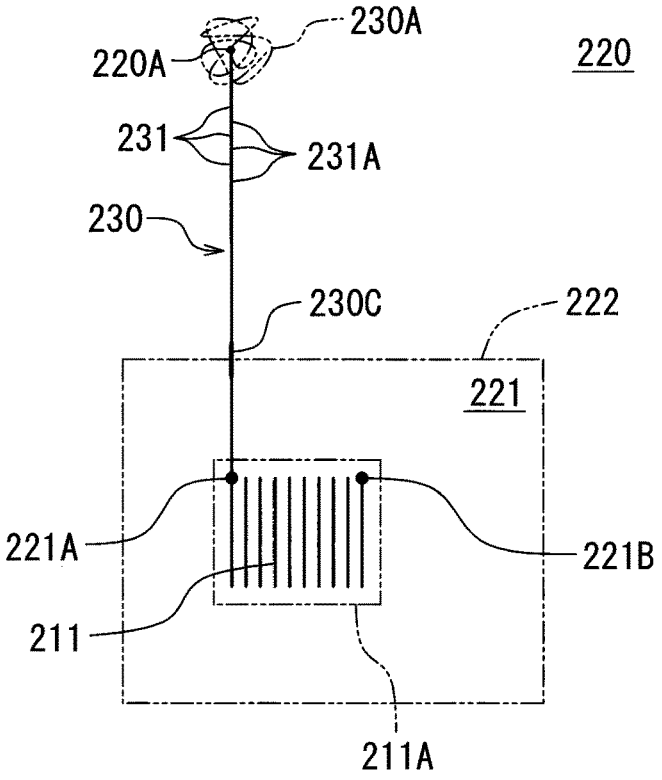
FIG. 10 is an explanatory diagram for explaining the method for producing the smart textile of FIG. 8.

Subsequently, the stitching pattern of the sewing machine is changed to the stitching pattern capable of forming a surface embroidery. For example, the stitching pattern may be changed to a "satin", "tatami" or "cross" stitch pattern. As shown in FIG. 10, the surface embroidery with the conductive thread 230 is sewn with the second point 221A as a starting point. This will apply the stitch 211 in the segmented area 211A.

Figure 11:
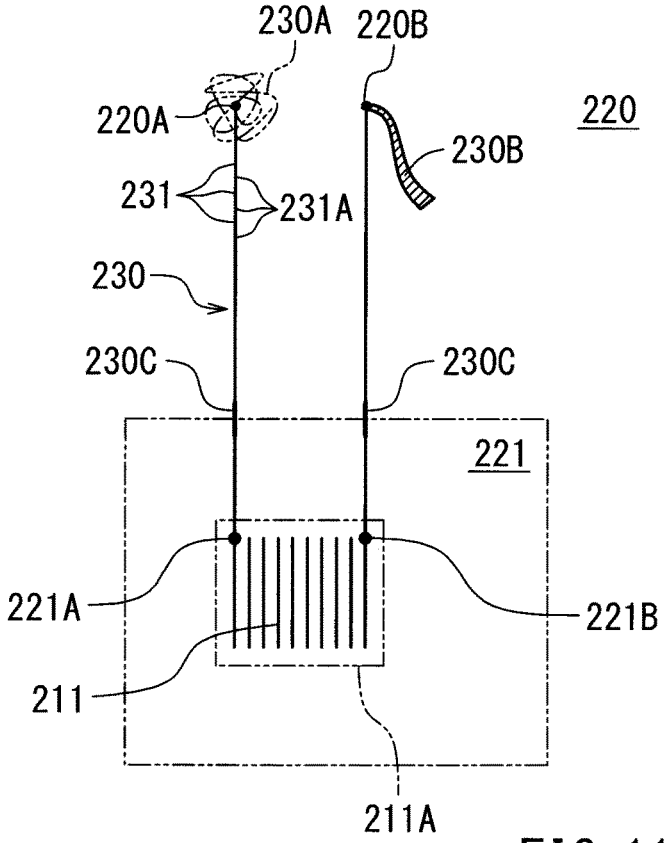
FIG. 11 is an explanatory diagram for explaining the method for producing the smart textile of FIG. 8.

Subsequently, the stitching pattern of the sewing machine is changed to the stitching pattern capable of proceeding with sewing in a linear fashion ("running" stitch pattern in this embodiment). Then, as shown in FIG. 11, a linear sewing with conductive thread 230 is advanced from the third point 221B. The third point 221B is a point within the area to be processed 221 (within the segmented area 211A as well), which serves as a sewing end point of the stitches 211. This sewing proceeds linearly toward a fourth point 220B outside the area to be processed 221 (outside the segmented area 211A as well) across the boundary 222. This step corresponds to the "second stitching step" in the present disclosure.

In the second stitching step, the fourth point 220B, which serves as the sewing end point, is set at a location spaced apart from the boundary 222 and the segmented area 211A and 112A by a predetermined distance. The predetermined distance is longer than the length of the thread tail 230B that is formed by the automatic thread trimming function of the sewing machine. Therefore, it is avoided that the thread tail 230B comes into contact with the stitches 211 in the segmented area 211A. When proceeding with the sewing, either the above jump stitch process or the stitch length adjustment process is performed. Then, a connecting thread 230C is provided where thread loops 231 are not formed at a location running across the boundary 222.

Here, a series of steps from the first stitching step through the embroidery step to the second stitching step is provided. This series of steps is executed without performing a process for cutting the conductive thread 230 by stopping the sewing process of the conductive thread 230.

When the sewing with the conductive thread 230 has advanced to the fourth point 220B, the sewing with the conductive thread 230 is stopped. Then, a thread cutting step is performed to cut the conductive thread 230. At this point, the conductive thread 230 is cut by the automatic thread trimming function of the sewing machine. As a result, a thread tail 230B of a predetermined length is formed at the fourth point 220B. This thread tail 230B extends out from the fourth point 220B.

Figure 12:
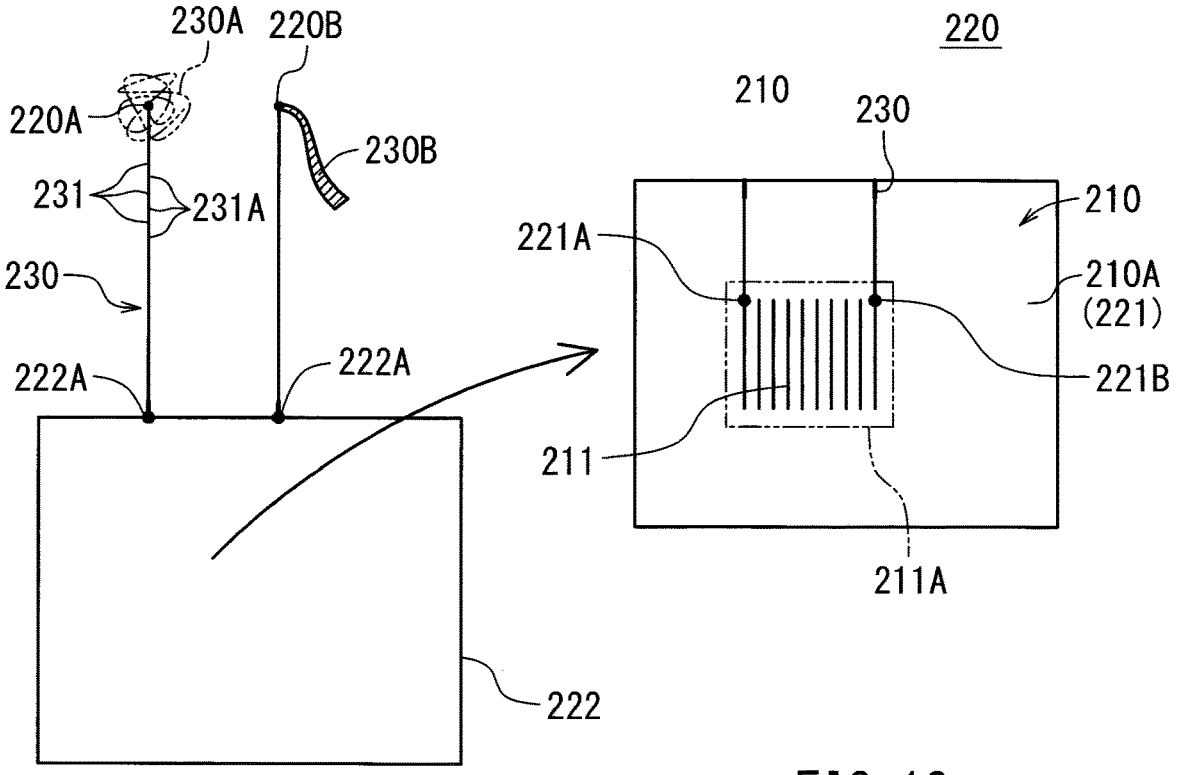
FIG. 12 is an explanatory diagram for explaining the method for producing the smart textile of FIG. 8.

As shown in FIG. 12, the sheet material 220 is then cut with the entire boundary 222 formed as a cutting line. The area to be processed 221 is thus separated from the rest of the sheet material 220. Here, the cutting is performed so that the connecting thread 230C of the conductive thread 230 extending across the boundary 222 is also cut together with the sheet material 220. The conductive thread 230 extends from the stitches 211 toward the outside the area to be processed 221. In other words, the cutting is performed so that the conductive thread 230 (FIG. 11) is cut at the cutting point 222A on the boundary 222.

The conductive thread 230, which forms the stitches 211, is thereby insulated and separated from the conductive thread 230 located outside the area to be processed 221. In other words, the cutting of the conductive thread 230 in the above-described cutting corresponds to a "cutting step" in this disclosure. In other words, the connecting thread 230C (FIG. 11) is provided at a location running across the cutting point 222A of the conductive thread 230 in the cutting step.

The area to be processed 221 applied with the stitches 211 is separated by the above-described cutting to form the base material 210A. In other words, the smart textile 210 is finished by performing the separation of the area to be processed 221 and the above-described cutting step together by cutting along the entire boundary 222 as the cutting line.

According to the method described above, the beginning of the sewing process by the sewing machine, where a bird nesting 230A may form, is located at a location spaced apart from the segmented area 211A. Therefore, even if the bird nesting 230A were to form in this area, the risk of this bird nesting 230A coming into contact with this segment (stitch 211) may be reduced. This reduces the need for additional work when producing the smart textile 210 by sewing machine. The additional work may involve a work, for example, to check for the presence or absence of the bird nesting 230A in the smart textile 210. Alternatively, it may be a work of removing the bird nesting 230A, if present.

A bird nesting 230A may be formed at the first point 220A, which serves as a sewing starting point of the sewing machine. However, even in this case, according to the above-described production method, this bird nesting 230A is avoided from coming into contact with the stitch 211. This may reduce the need for additional work.

The beginning of the sewing process by the sewing machine is also a location where the bird nesting 230A may form. According to the above-described method, the beginning of the sewing process by the sewing machine is insulated and separated from the segment (stitch 211) regardless of whether or not a bird nesting 230A has actually formed in this beginning of the sewing process by the sewing machine. This may reduce the need for additional work.

According to the above-described method, the bird nesting 230A is not likely to be formed within the segmented area 211A (stitch 211). Therefore, fraying, deformation or damage to the conductive threads 230, which are likely to occur as a result of the bird nesting 230A removal process, may be avoided. Thus, adverse effects on the function of the smart textile 210 as an electronic component or electronic circuit may be suppressed. This may improve the reliability of the product quality of the smart textile 210 produced accordingly.

According to the above-described method, the sewing end point of the sewing machine, where the thread tail 230B is formed, is positioned at a location spaced apart from the segmented area 211A. This reduces the risk of the thread tail 230B extending out from the sewing end point of the sewing machine coming into contact with the segment (stitch 211). This may reduce the risk of a short circuit and/or a leakage of electricity in the smart textile 210 produced by the sewing machine.

The thread tail 230B may also extend out from the fourth point 220B, which is the sewing machine's sewing end point. However, according to the above-described method, it is avoided that this thread tail 230B contacts the segmented area 211A. This may further reduce the risk of a short circuit and/or a leakage of electricity in the smart textile 210.

Further, according to the above-described method, the sewing end point of the sewing machine where the thread tail 230B is formed, is insulated and separated from the segment (stitch 211). This may further reduce the possibility of a short circuit and/or a leakage of electricity in the smart textile 210 produced by the sewing machine.

Further, according to the method described above, the insulation separation of stitch 211 and the separation of the area to be processed 221 are collectively done together. This improves production efficiency when producing smart the textile 210.

Furthermore, there may be a thread loop 231 where the conductive threads 230 entwine in the sewing process by the sewing machine. However, the thread loop 231 may be prevented from being located at a location running across the cutting point 222A of the conductive thread 230. As a result, it is possible to reduce the risk that the cutting of the conductive thread 230 becomes difficult in the cutting step due to the thread loop 231.

Third Embodiment

Next, a smart textile 310 produced by a production method of a third embodiment will be described primarily with reference to FIG. 13. This smart textile 310 has a sheet material 320 (see FIG. 19) made of insulating nonwoven fabric as a base material 310A. Two types of stitches 311 and 312 are applied on the base material 310A.

The stitches 311 are formed on the base material 310A, by a lockstitch embroidery machine (not shown), a type of sewing machine. The stitches 311 include two patterns 3111 and 3112 that are insulated and separated from each other. In this embodiment, the patterns 3111 and 3112 are formed on and along the segmented areas 3111A and 3112A, respectively, which are set in a form of strips.

Each of these patterns 3111 and 3112 is a linear embroidery sewn with lockstitch of the conductive thread 330. They serve as electrical wiring that is connected to other electronic components attached in the smart textile 310. In other words, the patterns 3111 and 3112 correspond to "segments" in the present disclosure.

Figure 13:
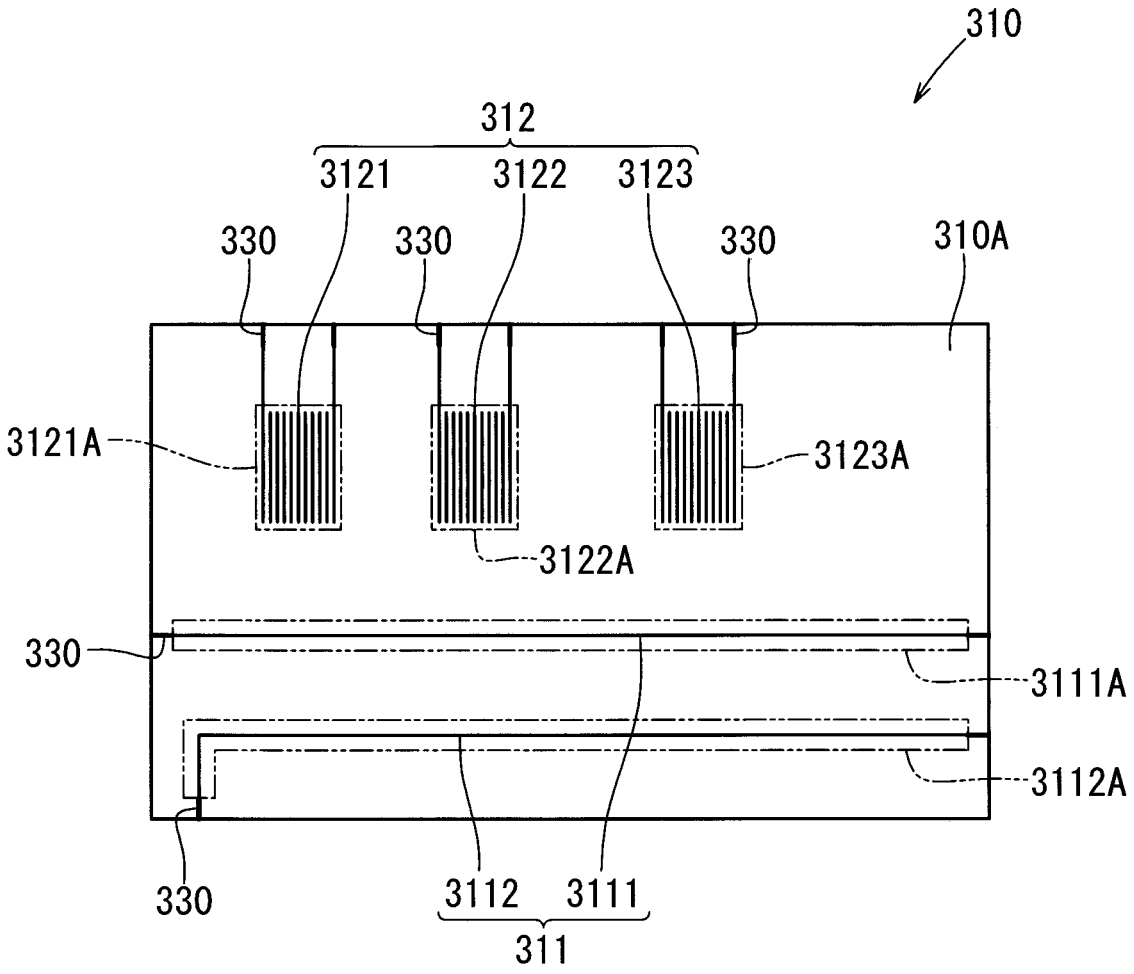
FIG. 13 is a surface view representing a smart textile produced by a method for producing smart textiles according to a third embodiment of the present disclosure.

In FIG. 13, each pattern 3111 and 3112 is illustrated as embroidery sewn by the "running" stitch pattern of the lockstitch. However, each pattern 3111 and 3112 may be formed by any stitch patterns capable of forming a linear embroidery.

The stitches 312 are formed by sewing three pads 3121, 3122, and 3123, which are insulated and separated from each other on the base material 310A by the lockstitch embroidery machine described above. In this embodiment, the pads 3121, 3122, and 3123 are applied to fill the entire surface on the segmented areas 3121A, 3122A, and 3123A, respectively, which are set in a planar shape. The segmented areas 3121A, 3122A, and 3123A are rectangular in FIG. 13, but may have other planar shapes, such as circular, for example.

These pads 3121, 3122, and 3123 are surface embroidery, each of which is sewn with lockstitch of conductive thread 330. The pads 3121, 3122, and 3123 correspond to "segments" in the present disclosure.

In this embodiment, the conductive thread 330 forming each pad 3121, 3122, and 3123 extends out of the pads 3121, 3122, and 3123 at its end. The conductive threads 330 are sewn to the base material 310A by a "running" stitch pattern of the lockstitch.

In FIG. 13, each pad 3121, 3122, and 3123 is illustrated as embroidery sewn by the "satin" stitch pattern of the lockstitch. However, each pad 3121, 3122, and 3123 may be formed by any stitch patterns capable of forming a surface embroidery, such as, for example, a "tatami" stitch pattern or a "cross" stitch pattern.

Hereinafter, an example of the method for producing the aforementioned smart textile 310 will be described, primarily with reference to FIG. 4 through FIG. 19. To produce the smart textile 310, a sewing machine with an embroidery function is first prepared.

Figure 14:
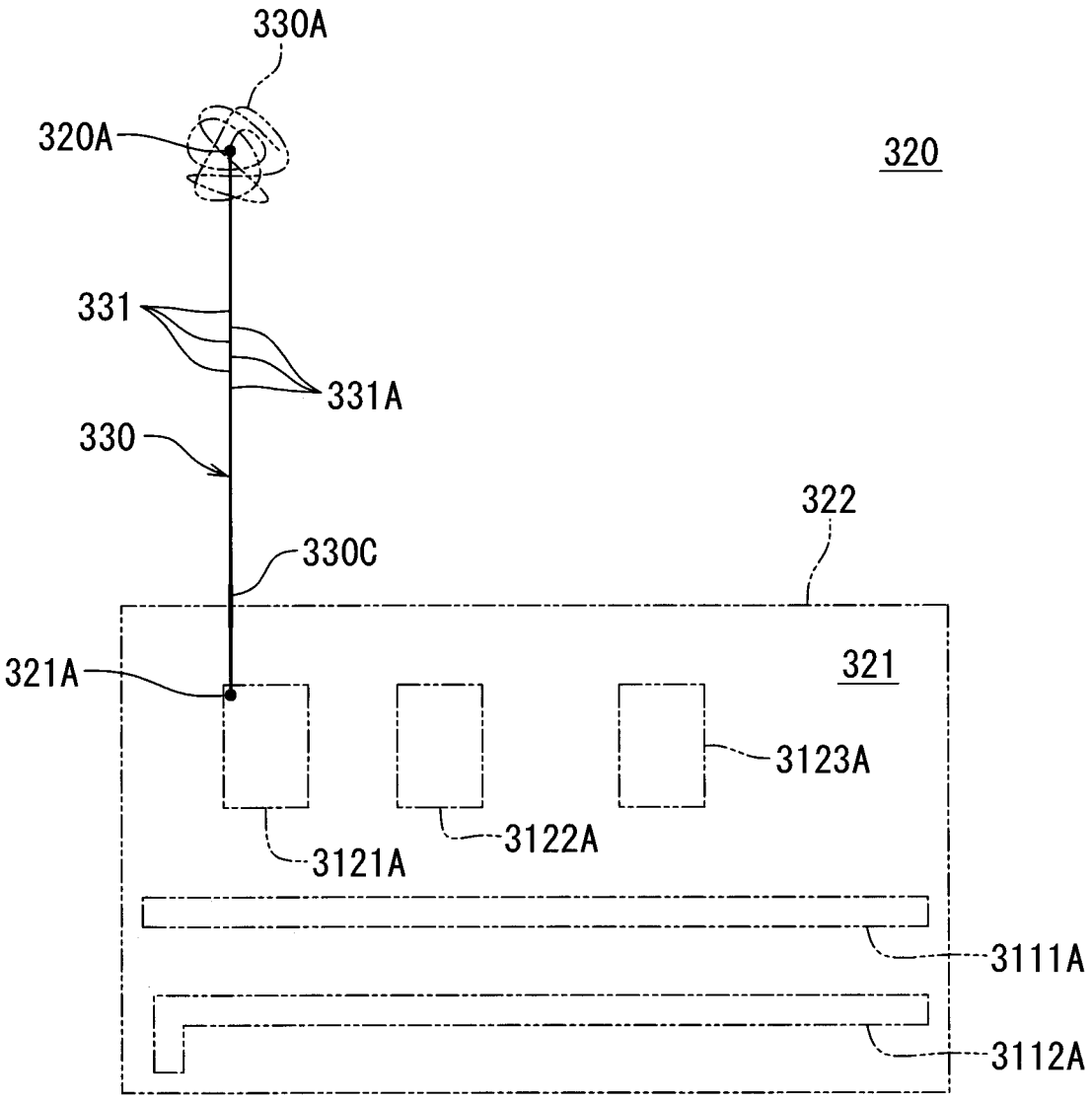
FIG. 14 is an explanatory diagram for explaining the method for producing the smart textile of FIG. 13.

As shown in FIG. 14, a sheet material 320 made of insulating non-woven fabric is prepared. Then, on this sheet material 320, an area to be processed 321 on the base material 310A (FIG. 13), a boundary 322 of this area to be processed 321, and each segmented area 3111A, 3112A, 3121A, 3122A and 3123A is set. At this time, each segmented area 3111A, 3112A, 3121A, 3122A and 3123A is set so that the entire segmented area is encompassed in the area to be processed 321. In FIG. 14, the boundary 322 of the area to be processed 321 and the boundary of each segmented area 3111A, 3112A, 3121A, 3122A and 3123A are illustrated as imaginary ones without physical forms. However, these boundaries may be physical markings made by a tool such as a "roulette" or "chalk," for example.

Subsequently, using the sewing machine described above, the sewing with the conductive thread 330 is advanced in a linear fashion from the first point 320A across the boundary 322 toward the second point 321A. The first point 320A is located at a location outside the area to be processed 321 and outside the segmented area 3121A as well. The second point 321A is located on the segmented area 3121A within the area to be processed 321. The linear sewing with the conductive thread 330 proceeds to form a straight line by "running" stitch pattern. This step corresponds to the "first stitching step" in the present disclosure.

In the first stitching step, the first point 320A is the sewing starting point. The first point 320A is set at a location spaced apart from the boundary 322 of the segmented area 3121A by a predetermined distance. The predetermined distance is a distance longer than the anticipated size of the bird nesting 330A. This ensures that the bird nesting 330A does not come into contact with the pad 3121 in segmented area 3121A. When proceeding with the stitching with the conductive thread 330, either the jump stitch process or the stitch length adjustment process is performed. A connecting thread 330C is provided where thread loops 331 are not formed at a location running across the boundary 322 of sewing with the conductive thread 330.

Figure 15:
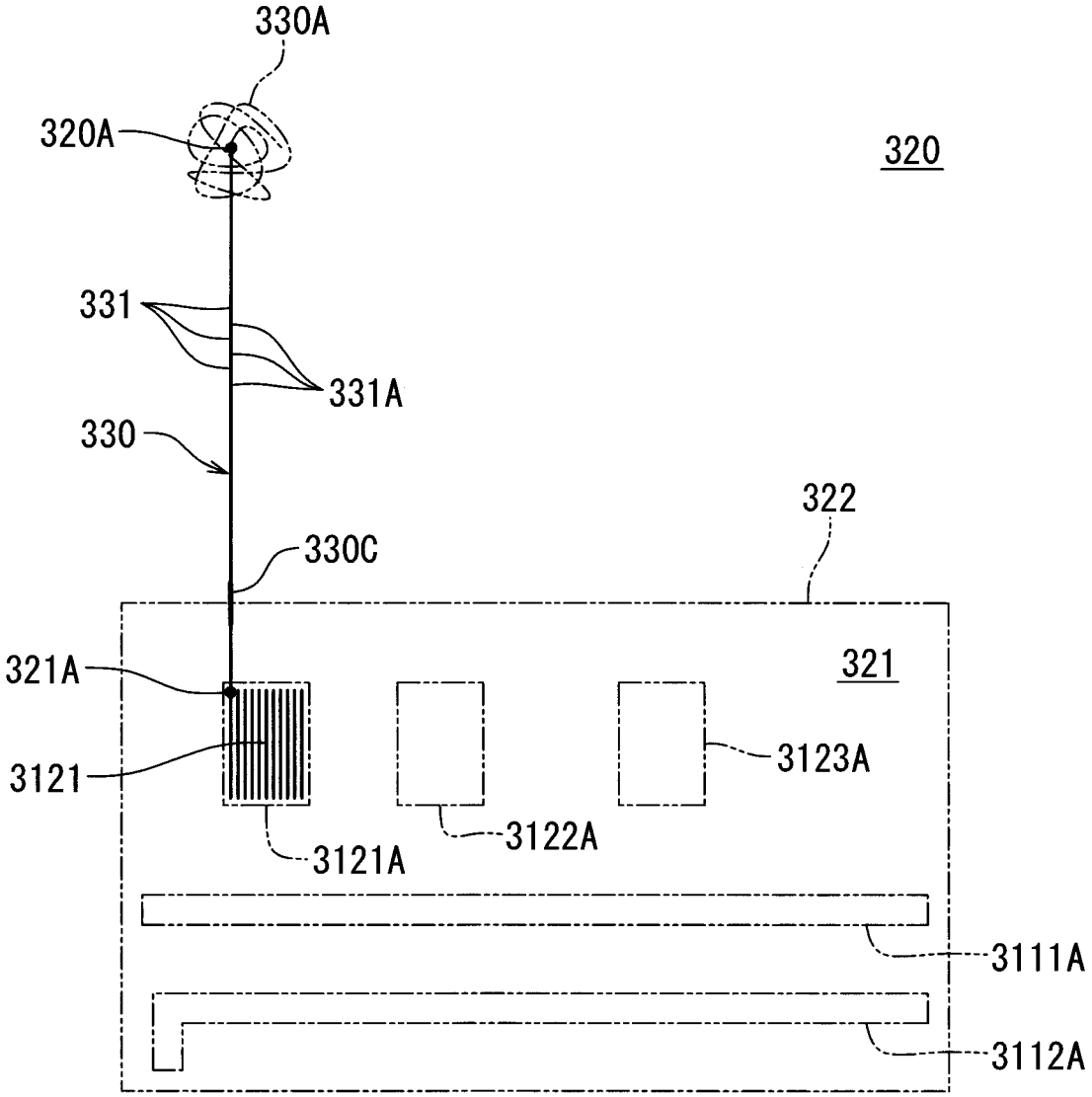
FIG. 15 is an explanatory diagram for explaining the method for producing the smart textile of FIG. 13.

Subsequently, the stitching pattern of the sewing machine is changed to the stitching pattern capable of proceeding with sewing in a planar fashion ("satin", "tatami" or "cross" stitch pattern in this embodiment). Then, as shown in FIG. 15, a surface stitch with conductive thread 330 is advanced from the second point 321A as a starting point. This forms a pad 3121 in the segmented area 3121A.

Figure 16:
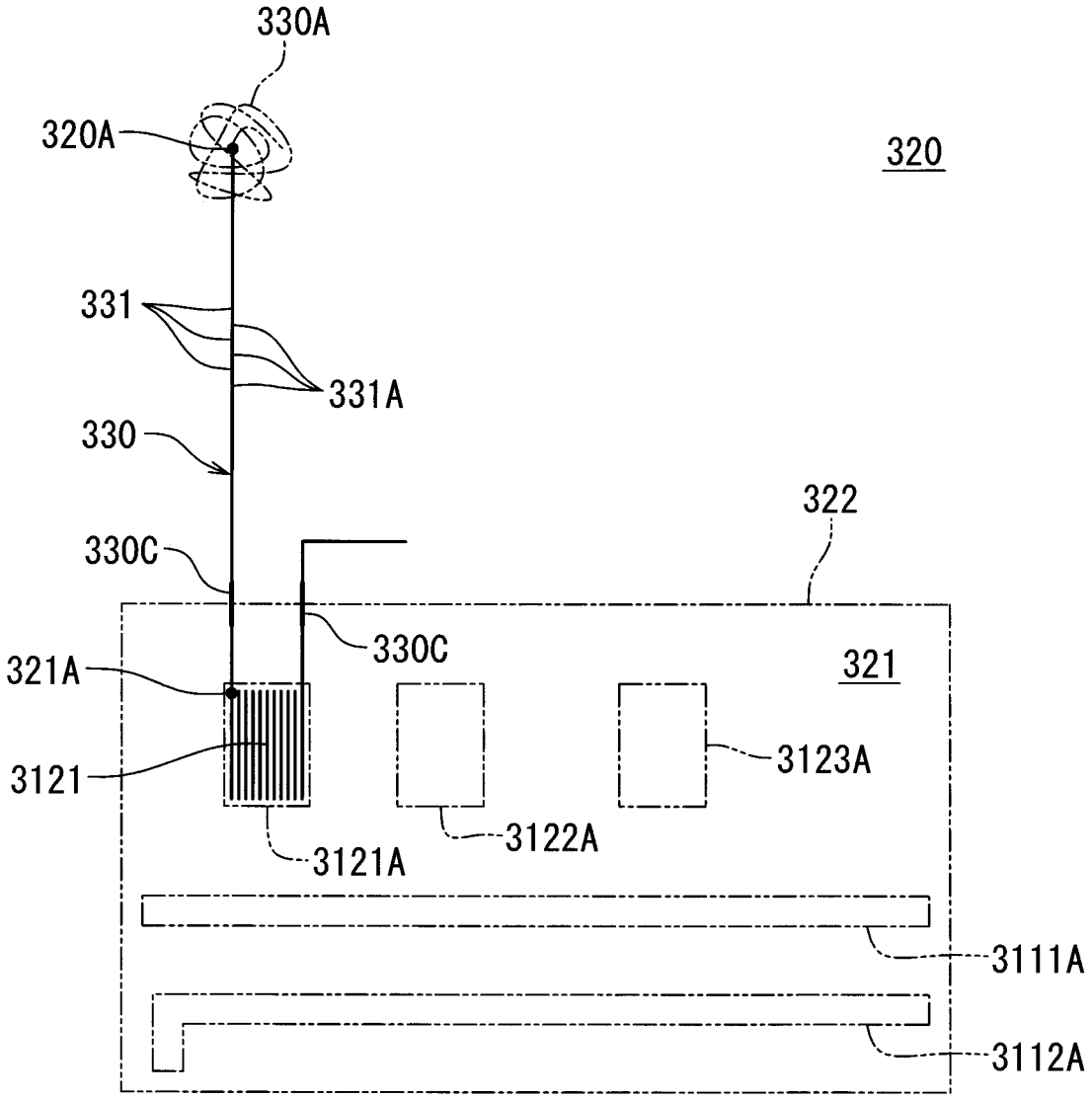
FIG. 16 is an explanatory diagram for explaining the method for producing the smart textile of FIG. 13.
Figure 17:
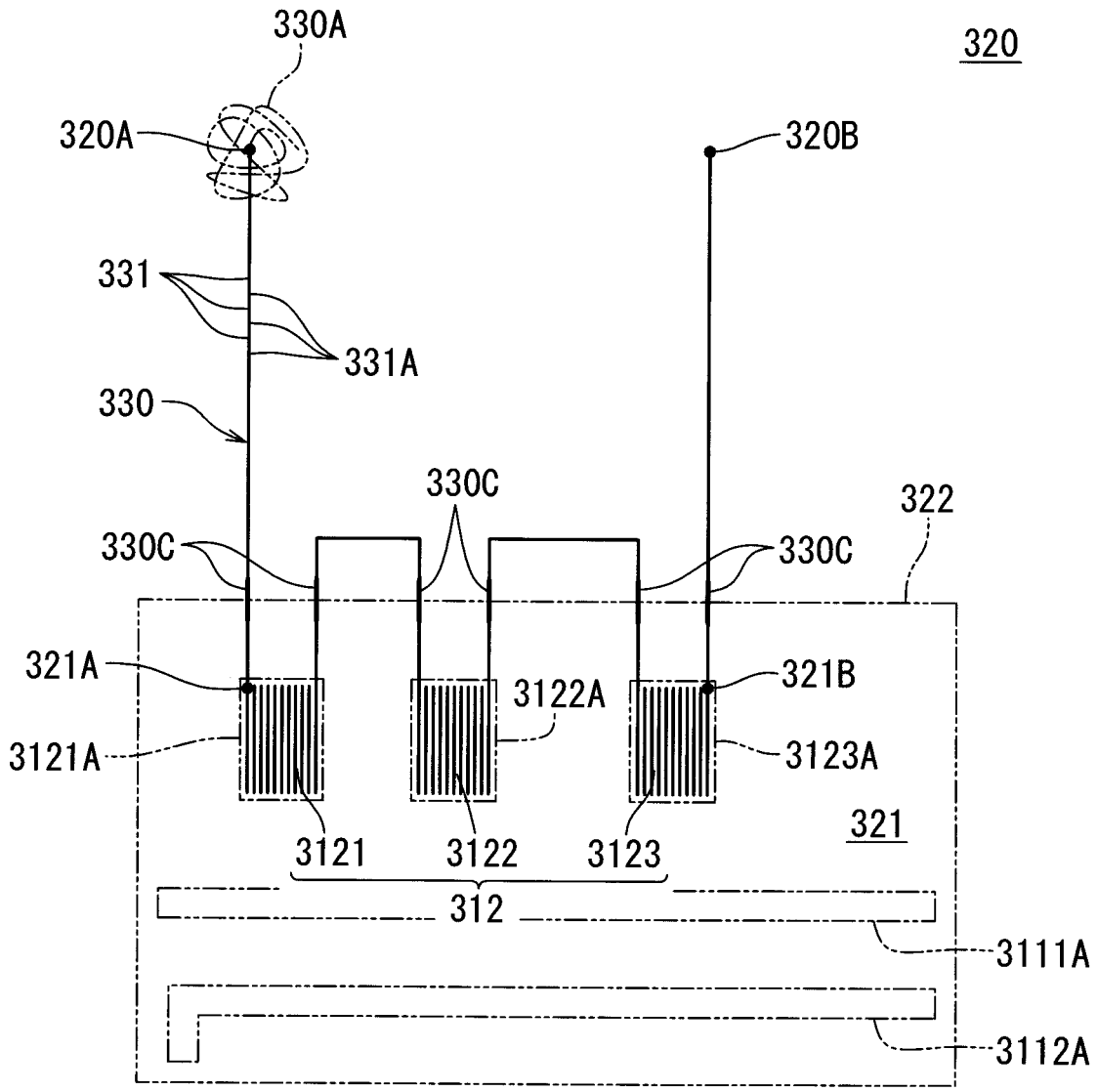
FIG. 17 is an explanatory diagram for explaining the method for producing the smart textile of FIG. 13.

Subsequently, the stitching pattern of the sewing machine is changed to the stitching pattern capable of proceeding with sewing in a linear fashion ("running" stitch pattern in this embodiment). Then, as shown in FIG. 16, a linear sewing with conductive thread 330 is advanced from the sewing end point of the pad 3121 toward the outside the area to be processed 321 (outside the segmented area 3121A as well) across the boundary 322. At this point, either the jump stitch process or the stitch length adjustment process is performed. A connecting thread 330C is provided where thread loops 331 are not formed at a location running across the boundary 322.

Subsequently, the linear sewing with the conductive thread 330 is advanced from outside the area to be processed 321 (outside the segmented area 3122A as well) toward the segmented area 3122A in the area to be processed 321 across the boundary 322. Afterwards, the stitching pattern of the sewing machine is changed to the stitching pattern capable of forming a surface embroidery to stitch a surface embroidery with the conductive thread 330. This forms a pad 3122 in the segmented area 3122A. Furthermore, by repeating the series of processes performed after forming the pad 3121 in the segmented area 3121A one more time, a pad 3123 is formed in a segmented area 3123A.

With these processes, the stitches 312 consisting of three pads 3121, 3122 and 3123 are applied in the area to be processed 321. This corresponds to the "embroidery step" in the present disclosure.

The sewing end point of the embroidery process of the linear stitches 312 with the conductive thread 330 is at the third point 321B, a point inside the area to be processed 321 (inside the segmented area 3123A as well). The stitching then proceeds from the third point 321B toward the fourth point 320B, which is outside the area to be processed 321, across the boundary 322. In this embodiment, the linear stitching with the conductive thread 330 proceeds to form a straight line by "running" stitch pattern. This step corresponds to the "second stitching step" in the present disclosure.

The sewing end point of the second stitching step is the fourth point 320B. The distance of the fourth point 320B from the boundary 322 and from each segmented area 3111A, 3112A, 3121A, 3122A and 3123A is longer than the length of the thread tail 330B (see FIG. 18), which may be formed by the automatic thread trimming function of the sewing machine. Therefore, the thread tail 330B does not contact each of the stitches 311 and 312. When proceeding with the stitching with the conductive thread 330, either the jump stitch process or the stitch length adjustment process is performed. A connecting thread 330C is provided where thread loops 331 are not formed at a location running across the boundary 322.

Here, a series of steps from the first stitching step through the embroidery step to the second stitching step is performed. This series of steps is executed without performing a process for cutting the conductive thread 330 by stopping the sewing process of the conductive thread 330.

Figure 18:
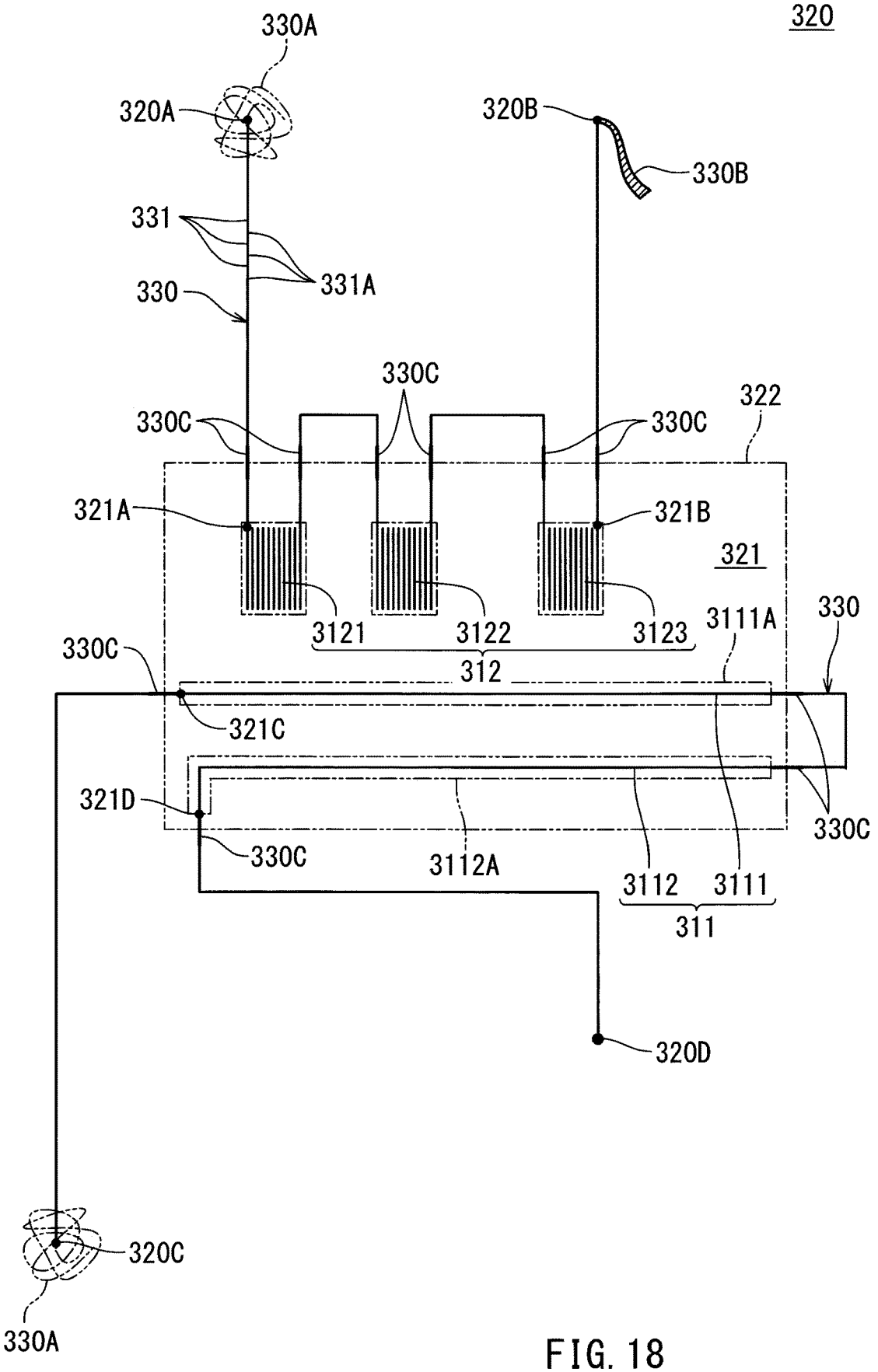
FIG. 18 is an explanatory diagram for explaining the method for producing the smart textile of FIG. 13.

When the sewing with the conductive thread 330 has advanced to the fourth point 320B, the sewing with the conductive thread 330 is stopped as shown in FIG. 18. Then, a thread cutting step is performed to cut the conductive thread 330. At this point, the conductive thread 330 is cut by the automatic thread trimming function of the sewing machine. At this time, the thread tail 330B of a predetermined length is formed at the fourth point 320B. This thread tail 330B extends out from the fourth point 320B.

Subsequently, a series of steps similar to those described above from the first stitching step through the embroidery step to the second stitching step is also performed. As a result, stitches 311 are applied in the area to be processed 321. Each step to make the area to be processed 321 with stitches 311 is the same as the step to apply stitches 312 in the area to be processed 321, except for the following steps (A) through (C).

(A) In stitches 312, a linear sewing with the conductive thread 330 proceeds from the first point 320A toward the second point 321A. Instead, in stitches 311, a linear stitch may proceed with the conductive thread 330 may proceed from the first point 320C toward the second point 321C.

(B) In stitches 312, the embroidery on each pad 3121, 3122 and 3123 is sewn after the stitching pattern of the sewing machine is changed to the stitching pattern capable of forming a surface embroidery. Instead, in stitches 311, the embroidery of each pattern 3111 and 3112 is sewn without changing the stitching pattern of the sewing machine.

Figure 19:
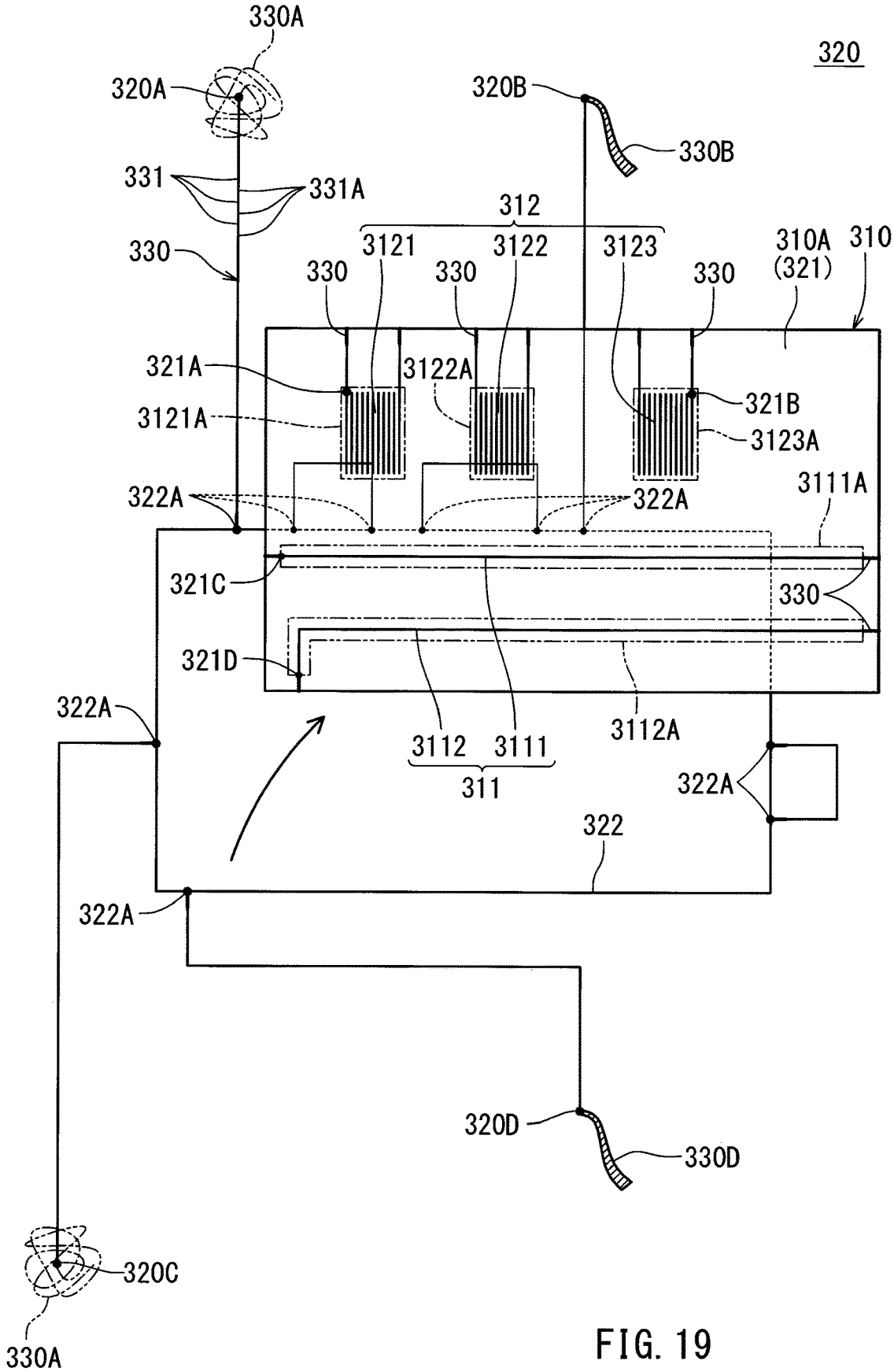
FIG. 19 is an explanatory diagram for explaining the method for producing the smart textile of FIG. 13.

(C) In stitches 312, a linear sewing with the conductive thread 330 proceeds from the third point 321B toward the fourth point 320B. Instead, in stitches 311, a linear sewing with the conductive thread 330 may proceed from the third point 321D toward the fourth point 320D. When the sewing with the conductive thread 330 has advanced to the fourth point 320D, the sewing with the conductive thread 330 is stopped, as shown in FIG. 19. Then, the thread trimming step to cut the conductive thread 330 is executed. At this point, the conductive thread 330 is cut by the automatic thread trimming function of the sewing machine. As a result, a thread tail 330D of the same length as the thread tail 330B is formed at the fourth point 320B.

The sheet material 320 is then cut with the entire boundary 322 formed as a cutting line. The area to be processed 321 is thus separated from the rest of the sheet material 320. Here, the cutting is performed so that the connecting thread 330C of the conductive thread 330 extending across the boundary 322 is also cut together with the sheet material 320. The thread 330 extends from the stitches 311 and 312 toward outside the area to be processed 321 as shown in FIG. 18. The thread 330C is cut at the cutting point 322A on the boundary 322.

Each pattern 3111 and 3112 of the stitches 311 and each pad 3121, 3122 and 3123 of the stitches 312 is thereby insulated and separated from each other. Further, the conductive thread 330, which forms the stitches 311 and 312 is also insulated and separated from the conductive thread 330 outside the area to be processed 321. In other words, the cutting of the conductive thread 330 in the above-described cutting corresponds to the "cutting step" in this disclosure. In other words, the connecting thread 330C (FIG. 18) is provided at a location running across the cutting point 322A of the conductive thread 330 in the cutting step.

The area to be processed 321 applied with the stitches 311 and 312 is separated by the above-described cutting to form the base material 310A. In other words, the smart textile 310 is finished by performing the separation of the area to be processed 321 and the above-described cutting step together by cutting along the entire boundary 322 as the cutting line.

According to the above-described method, the beginning of the sewing process by the sewing machine, where a bird nesting 330A may form, is located at a location spaced apart from each segmented areas 3111A, 3112A, 3121A, 3122A and 3123A. Therefore, even if the bird nesting 330A forms within this area, the risk of this bird nesting 330A coming into contact with each segment (each pattern 3111, 3112 and each pad 3121, 3122 and 3123) may be reduced. This reduces the need for additional work when producing the smart textile 310 by sewing machine. The additional work is needed, for example, to check for the presence or absence of the bird nesting 330A in the smart textile 310. Alternatively, it may be a work of removing the bird nesting 330A, if present.

A bird nesting 330A may be formed at the first point 320A, which serves as a sewing starting point of the sewing machine. However, even in this case, according to the above-described production method, this bird nesting 330A is avoided from coming into contact with each segment (each pattern 3111, 3112 and each pad 3121, 3122 and 3123).

The beginning of the sewing process by the sewing machine is also a location where the bird nesting 330A may form. According to the above-described method, the beginning of the sewing process by the sewing machine is insulated and separated from each segment regardless of whether or not a bird nesting 330A has actually formed in this beginning of the sewing process by the sewing machine. This may reduce the need for additional work.

According to the above-described method, the bird nesting 330A is not likely to be formed within each segmented area 3111A, 3112A, 3121A, 3122A and 3123A (each pattern 3111, 3112 in stitch 311 and each pad 3121, 3122, 3123 in stitch 312). Therefore, fraying, deformation or damage to the conductive threads 330, which are likely to occur as a result of the bird nesting 330A removal process, may be avoided. Thus, adverse effects on the function of the smart textile 310 as an electronic component or electronic circuit may be suppressed. This may improve the reliability of the product quality of the smart textile 310 produced accordingly.

According to the above-described method, the sewing end point of the sewing machine, where the thread tails 330B and 330D are formed, is positioned at a location spaced apart from each segmented area 3111A, 3112A, 3121A, 3122A and 3123A. This reduces the risk of the thread tails 330B and 330D extending out from the sewing end point coming into contact with each segment (each pattern 3111, 3112 and each pad 3121, 3122, 3123). This may reduce the risk of a short circuit and/or a leakage of electricity in the smart textile 310.

The thread tails 330B and 330D also extend out from the fourth points 320B and 320D, which are the sewing end points of the sewing machine. However, according to the above-described method, it is avoided that these thread tails 330B and 330D contact each segmented area 3111A, 3112A, 3121A, 3122A and 3123A. This may further reduce the risk of a short circuit and/or a leakage of electricity in the smart textile 310.

Further, according to the above-described method, the sewing end point is insulated and separated from each segment (each pattern 3111, 3112 and each pad 3121, 3122, 3123). This may further reduce the possibility of a short circuit and/or a leakage of electricity in the smart textile 310.

Further, according to the above-described method, the insulation separation of stitches 311 and 312 and the separation of the area to be processed 321 are collectively done together. This improves production efficiency when producing smart the textile 310.

Furthermore, there may be thread loops 331 where the conductive threads 330 entwine in the sewing process by the sewing machine. However, according to the above-described method, the thread loops 331 may be prevented from being located at a location running across the cutting point 322A of the conductive thread 330. As a result, it is possible to reduce the risk that the cutting of the conductive thread 330 becomes difficult in the cutting step due to the thread loops 331.

The present disclosure shall not be limited to the appearance and configuration described in the first through third embodiments above, and various modifications, additions, and deletions are possible without departing from the scope of one embodiment of this disclosure. For example, the following various embodiments may be implemented.

(1) Smart textiles shall not be limited to be produced by the lockstitch embroidery machines, but may be produced by any type of sewing machine, for example, sewing machines with embroidery functions or chain stitch embroidery machines. If the sewing machine is the one capable of sewing in a pattern classified as "single-thread chain stitch" among the chain stitches, it is preferable to proceed with sewing in a pattern classified as "single-thread chain stitch" for areas other than the area to be processed. Here, threads sewn in a stitch pattern classified as "single-thread chain stitch" are cut at one point in the stitch such that the threads sewn before this cut point can be easily pulled out and removed. Therefore, the sewing outside the area to be processed is performed in a stitch pattern classified as "single-thread chain stitch". In the cutting step, the conductive thread is cut, and then pulled out and removed. This allows easy removal of conductive threads without cutting the boundary of the area to be processed.

(2) The sewing machine is capable of automatically executing both the jump stitch process and the stitch length adjustment process described above. Alternatively, the sewing machine may be capable of automatically executing any one of the above processes. If the sewing machine is not capable of automatically executing the jump stitch process, the smart textile producer may interrupt stitching with the conductive thread and then manually execute the jump stitch process. If the sewing machine is not capable of automatically executing the stitch length adjustment process, the smart textile producer may perform the stitch length adjustment process manually. Here, in the example of how to manually execute the stitch length adjustment process, the stitching with the conductive thread is stopped once in the stitch length adjustment process. Then, the setting of the stitch count setting dial of the sewing machine is changed, and sewing is resumed. In the stitch length adjustment process, the stitching with the conductive thread is stopped again. Then, the setting of the stitch count setting dial of the sewing machine is returned to the original setting, and sewing is resumed.

(3) The smart textile base material shall not be limited to those formed by cutting the entire boundaries of the area to be processed as the cutting line. For example, the area to be processed may be set so that the edges of the sheet material are included as boundaries. This makes it possible to separate the area to be processed from the base material by cutting a part of the boundary of the area to be processed as a cutting line. Alternatively, additional processing may be performed on the area to be processed that has been separated by cutting to form the base material. Specific examples of additional processing may include, for example, trimming, drilling, or attaching other electronic components. The entire sheet material may be formed as a base material by executing the cutting step of the conductive threads without cutting the boundaries of the area to be processed.

(4) In the method shown in FIG. 18, the connecting thread 330C is provided only at a location running across boundary 322 of the area to be processed 321 in a linear stitch with the conductive thread 330. However, the connecting thread of the conductive thread may be provided so as to extend over between a point outside the area to be processed and a sewing starting point (second point) or sewing end point (third point) of the sewing. According to this technique, a cutting point for insulating and separating the conductive thread that forms stitches with the conductive thread located outside the area to be processed may be set at a location adjacent to this stitch or inside the stitch. It is then possible to ensure that no conductive threads other than the conductive threads that form this stitch remain in the base material of the smart textile.

(5) The function as an element exhibited by a segment applied to a smart textile shall not be limited to the above-described function of the pattern or function of the pad. The segment may, for example, have a formation of a hemstitch along the edge of a through hole formed in the base material. This may allow the segment to function as a via hole, an element that serves as a bypass path for the current that passes through the front and back of the base material. The two segments may be two systems of stitches, each insulated and separated from the other and may be placed close to each other. This may allow the two segments to function as a capacitor, an element that makes it possible to store an electric charge between these two systems. Here, the above configuration of bringing the two systems of stitches close to each other may be, for example, a configuration in which these stitches are applied at locations adjacent to each other, or a configuration in which the two systems of stitches applied at positions apart from each other are brought close to each other by folding the base material.

(6) In the production method of the present disclosure, the cutting step of cutting the conductive threads extending from the segment toward the outside the segmented area is not necessarily essential. For example, if a plurality of segments are densely arranged such that the conductive threads form a bird nesting or thread tails, they may come into contact with other segments. In this case, execution of the above cutting step is appropriate. However, there may be cases where, for example, if the conductive thread extending from the segment toward the outside the segmented area is spaced apart from other elements and/or conductors, and even if the conductive thread has a bird nesting or a thread tail, it is considered that there is no risk of a short circuit and/or a leakage of electricity. In this case, the smart textile may be finished with this conductive thread remaining on the base material. Also, for example, there may be cases where a conductive thread whose conductivity is ensured by plating on the surface of the thread is used. In this case, plating is removed from a portion of the conductive thread on the segment side extending from the segment toward the outside the segmented area. This makes it possible to insulate and separate from the segment without cutting the conductive thread.

The invention claimed is:

1. A method for producing a smart textile using a sewing machine, wherein the smart textile has stitching with a conductive thread being applied on a base material made of an insulating sheet material, the method comprising:

a first stitching step, wherein:

a segmented area is set on the insulating sheet material where a conductive segment forming an electrical circuit equivalent to the stitching is located, the conductive segment serving as a functional element, and stitching having the conductive thread is initiated from a first point outside the segmented area and proceeds toward a second point located in the segmented area over a boundary of the segmented area, wherein the first point is a sewing starting point of the sewing machine, and wherein the first point is set at a distance from the segmented area to prevent short-circuiting the element, the distance being greater than an anticipated maximum radial width of a bird nesting formable at the first point; and an embroidery step, wherein an embroidery having the conductive thread is sewn from the second point starting to apply the segment in the segmented area, wherein a series of steps from the first stitching step through the embroidery step is executed without performing a process for cutting the conductive thread by stopping the sewing process with the conductive thread.

2. The method of claim 1, further comprising a step of cutting the conductive thread, wherein the conductive thread extends from the segment toward the outside the segmented area for insulating and separating the conductive thread constituting the segment from the conductive thread outside the segmented area.

3. The method of claim 1, further comprising:

a second stitching step, wherein the stitching with the conductive thread starting from a third point located on the segmented area where the embroidery step ends to a fourth point located on outside the segmented area, and a thread cutting step, wherein the stitching with the conductive thread is stopped at the fourth point and the conductive thread is cut, wherein a series of steps from the first stitching step through the embroidery step to the second stitching step is executed without performing a process for cutting the conductive thread by stopping the sewing process with the conductive thread.

4. The method of claim 3, wherein the fourth point is set at a location spaced apart from the segmented area by a distance longer than a length of a thread tail of the conductive thread extending from the fourth point by the thread cutting step.

5. The method of claim 2, further comprising steps of:

setting an area to be processed and a boundary of the area to be processed on the sheet material, the area to be processed encompassing the segmented area and being an area to be processed on the base material, setting the first point outside the area to be processed, proceeding with stitching with the conductive thread from the first point across the boundary toward the second point in the first stitching step, and separating and executing the cutting step of the area to be processed together by cutting with at least a part of the boundary as a cutting line.

6. The method of claim 2, further comprising:

a second stitching step, wherein the stitching with the conductive thread proceeds from a third point on the segmented area, the third point being the embroidery process ends, toward a fourth point outside the segmented area, and a thread cutting step, wherein the stitching with the conductive thread is stopped at the fourth point and the conductive thread is cut, wherein a series of steps from the first stitching step through the embroidery step to the second stitching step is executed without performing a process for cutting the conductive thread by stopping the sewing process with the conductive thread, the method further comprising steps of:

setting an area to be processed and a boundary of the area to be processed on the sheet material, the area to be processed encompassing the segmented area and being an area to be processed on the base material, setting the fourth point outside the area to be processed, proceeding with stitching with the conductive thread from the third point across the boundary toward the fourth point in the second stitching step, and separating and executing the cutting step of the area to be processed together by cutting with at least a part of the boundary as a cutting line.

7. The method of claim 2, wherein a connecting thread without a thread loop is formed at a location running across a cutting point of the conductive thread during the cutting step.

8. A method for producing smart textiles using a sewing machine, the smart textiles have stitching with a conductive thread being applied on an insulating sheet material, the method comprising:

segmenting an area on the insulating sheet material to form a segment, wherein the segment is equivalent to the stitching, and wherein the stitching having the conductive thread starts from a first point outside the segmented area to a second point on the segmented area, wherein the first point is a sewing starting point of the sewing machine spaced apart from the segmented area to isolate the segment from bird nesting formable outside the segmented area; and sewing an embroidery having the conductive thread from the second point to apply the segment on the segmented area, wherein the steps of segmenting and sewing are continuously performed without performing a process for cutting the conductive thread.

* * * * *